US009869959B2

(12) United States Patent
Tobinaga et al.

(10) Patent No.: US 9,869,959 B2
(45) Date of Patent: *Jan. 16, 2018

(54) IMAGE FORMING APPARATUS

(71) Applicants: Hideki Tobinaga, Kanagawa (JP); Hajime Nishida, Kanagawa (JP); Jumpei Aoyama, Kanagawa (JP); Junpei Kamichi, Tokyo (JP); Satoshi Kuno, Tokyo (JP); Shun Kobayashi, Kanagawa (JP); Manabu Nonaka, Kanagawa (JP)

(72) Inventors: Hideki Tobinaga, Kanagawa (JP); Hajime Nishida, Kanagawa (JP); Jumpei Aoyama, Kanagawa (JP); Junpei Kamichi, Tokyo (JP); Satoshi Kuno, Tokyo (JP); Shun Kobayashi, Kanagawa (JP); Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/397,131

(22) Filed: Jan. 3, 2017

(65) Prior Publication Data

US 2017/0115618 A1 Apr. 27, 2017

Related U.S. Application Data

(63) Continuation of application No. 14/536,955, filed on Nov. 10, 2014, now Pat. No. 9,568,879.

(30) Foreign Application Priority Data

Nov. 11, 2013 (JP) ..... 2013-232992

(51) Int. Cl.
*B65H 3/52* (2006.01)
*G03G 15/00* (2006.01)
(Continued)

(52) U.S. Cl.
CPC ..... *G03G 15/6529* (2013.01); *B65H 1/266* (2013.01); *B65H 3/46* (2013.01);
(Continued)

(58) Field of Classification Search
CPC ..... B65H 3/5215; B65H 2301/4234; B65H 3/46; B65H 7/12; B65H 5/062;
(Continued)

(56) References Cited

U.S. PATENT DOCUMENTS

2007/0209539 A1 9/2007 Mori
2008/0128972 A1 6/2008 Kishimoto et al.
(Continued)

FOREIGN PATENT DOCUMENTS

JP 06298385 10/1994
JP H06298385 A 10/1994
(Continued)

*Primary Examiner* — R. A. Smith
*Assistant Examiner* — John M Royston
(74) *Attorney, Agent, or Firm* — Harness, Dickey & Pierce, P.L.C.

(57) ABSTRACT

An image forming apparatus includes an apparatus body, a sheet container, an image forming part to form an image, a sheet feeding rotary body to feed the recording medium, a sheet separating rotary body to contact the sheet feeding rotary body and rotate with the sheet feeding rotary body with a sheet separation nip region formed therebetween, a rotation adjusting unit to adjust rotation of the sheet separating rotary body, a sheet containing unit to contain the recording media therein, a sheet separating body storing unit disposed at one end of the sheet containing unit to store the sheet separating body therein, and a load resistance applying mechanism to apply a rotational load resistance different from a contact force generated by contacting of the sheet
(Continued)

separating rotary body with the sheet feeding rotary body, to the sheet feeding rotary body with no rotation driving force applied thereto.

11 Claims, 16 Drawing Sheets

(51) Int. Cl.

| | |
|---|---|
| ***B65H 3/46*** | (2006.01) |
| ***B65H 7/12*** | (2006.01) |
| ***B65H 5/06*** | (2006.01) |
| ***B65H 9/16*** | (2006.01) |
| ***B65H 1/26*** | (2006.01) |

(52) U.S. Cl.
CPC ..... *B65H 3/5215* (2013.01); *B65H 5/062* (2013.01); *B65H 9/166* (2013.01); *B65H 7/12* (2013.01); *B65H 2301/4234* (2013.01); *G03G 15/6511* (2013.01); *G03G 2215/004* (2013.01)

(58) Field of Classification Search
CPC ..... G03G 15/6511; G03G 2215/005; G03G 2215/0054
See application file for complete search history.

(56) References Cited

U.S. PATENT DOCUMENTS

| | | | |
|---|---|---|---|
| 2011/0052227 | A1 | 3/2011 | Toyooka et al. |
| 2011/0062651 | A1 | 3/2011 | Higaki et al. |
| 2011/0062655 | A1 | 3/2011 | Togashi et al. |
| 2011/0121506 | A1 | 5/2011 | Ishikawa et al. |
| 2011/0127711 | A1 | 6/2011 | Takahashi et al. |
| 2011/0204557 | A1 | 8/2011 | Ishikawa et al. |
| 2011/0204558 | A1 | 8/2011 | Takahashi et al. |
| 2012/0193861 | A1 | 8/2012 | Takahashi et al. |
| 2012/0235346 | A1 | 9/2012 | Ikeda et al. |
| 2012/0306146 | A1 | 12/2012 | Higaki et al. |
| 2012/0326382 | A1 | 12/2012 | Hayayumi |
| 2013/0113869 | A1 | 5/2013 | Kobayashi et al. |
| 2013/0161894 | A1 | 6/2013 | Ishikawa et al. |
| 2014/0183813 | A1 | 7/2014 | Aoyama |
| 2014/0210157 | A1 | 7/2014 | Aoyama |

FOREIGN PATENT DOCUMENTS

| | | | |
|---|---|---|---|
| JP | 2001026329 | A | 1/2001 |
| JP | 2002080133 | A | 3/2002 |
| JP | 2002307737 | A | 10/2002 |
| JP | 2003002474 | A | 1/2003 |
| JP | 04094332 | B2 | 6/2008 |

IMAGE FORMING APPARATUS

CROSS-REFERENCE TO RELATED APPLICATIONS

This application is a continuation of U.S. application Ser. No. 14/536,955, filed Nov. 10, 2014, which claims priority pursuant to 35 U.S.C. §119(a) to Japanese Patent Application No. 2013-232992, filed on Nov. 11, 2013, in the Japan Patent Office, the entire contents of each of which are hereby incorporated by reference herein.

BACKGROUND

Technical Field

This disclosure relates to an image forming apparatus in which multiple recording media accumulated as a sheet stack in a sheet container pass one by one through a sheet separation nip region formed by a sheet feeding body and a sheet separating body to separate a recording medium that directly contact the sheet feeding body out of the multiple recording media and to feed the recording medium from the sheet container toward an image forming part provided in the image forming apparatus.

Related Art

As an example of known image forming apparatuses, some image forming apparatuses do not include a pickup roller and causes a sheet feed roller to function as a pickup roller. This configuration can achieve a reduction in cost without a pickup roller.

Such a known sheet feed roller form a sheet separation nip region with a sheet separating roller. A recording medium is held in the sheet separation nip region formed between the sheet feed roller and the sheet separating roller to be separated from the other recording media in the sheet container and be fed toward the image forming part further passing through some other nip regions including a sheet conveyance nip region formed downstream from the sheet separation nip region in a sheet conveying direction.

When a paper jam occurs in a vicinity of the sheet separation nip region, a jammed sheet is generally held in the sheet conveyance nip region at a leading end thereof and in the sheet separation nip region at a trailing end thereof. In order to remove an image forming apparatus having the above-described configuration, the sheet container that is attached to an apparatus body of the image forming apparatus is slidably detached from the apparatus body, so that a user can insert the hand into the apparatus body and grab the jammed sheet to be removed.

Further, when two or more sheets are held in the sheet separation nip region, a subsequent sheet that is conveyed after a preceding sheet can have crease or fold. However, if the image forming apparatus includes a one-way clutch, the crease or fold in the subsequent sheet can be prevented.

SUMMARY

At least one aspect of this disclosure provides an image forming apparatus including an apparatus body, a sheet container, an image forming part, a sheet feeding rotary body, a sheet separating rotary body, a rotation adjusting unit, a sheet containing unit, a sheet separating body storing unit, and a load resistance applying mechanism. The sheet container is detachably attachable to the apparatus body and accommodates recording media therein. The image forming part forms an image on each of the recording media accommodated in the sheet container. The sheet feeding rotary body rotates about a rotary shaft thereof and feed the recording media from the sheet container. The sheet separating rotary body is provided to the sheet container, is detachably attachable to the apparatus body together with the sheet container, and contacts the sheet feeding rotary body and rotating about a rotary shaft thereof with the sheet feeding rotary body with a sheet separation nip region formed therebetween. The rotation adjusting unit adjusts rotation of the sheet separating rotary body by allowing rotation of the sheet separating rotary body when a single recording medium of the recording media is fed from the sheet container and by stopping the rotation of the sheet separating rotary body when multiple recording media of the recording media are fed from the sheet container. The sheet containing unit is included in the sheet container to contain the recording media therein. The sheet separating body storing unit is included in the sheet container and is disposed at one end of the sheet containing unit to store the sheet separating body therein. The sheet container is pulled out from the sheet containing unit toward the sheet separating body storing unit. The load resistance applying mechanism applies a rotational load resistance different from a contact force generated by contacting of the sheet separating rotary body with the sheet feeding rotary body, to the sheet feeding rotary body with no rotation driving force applied thereto.

BRIEF DESCRIPTION OF THE DRAWINGS

A more complete appreciation of the disclosure and many of the advantages thereof will be obtained as the same becomes better understood by reference to the following detailed description when considered in connection with the accompanying drawings, wherein.

DETAILED DESCRIPTION

Figure 1:
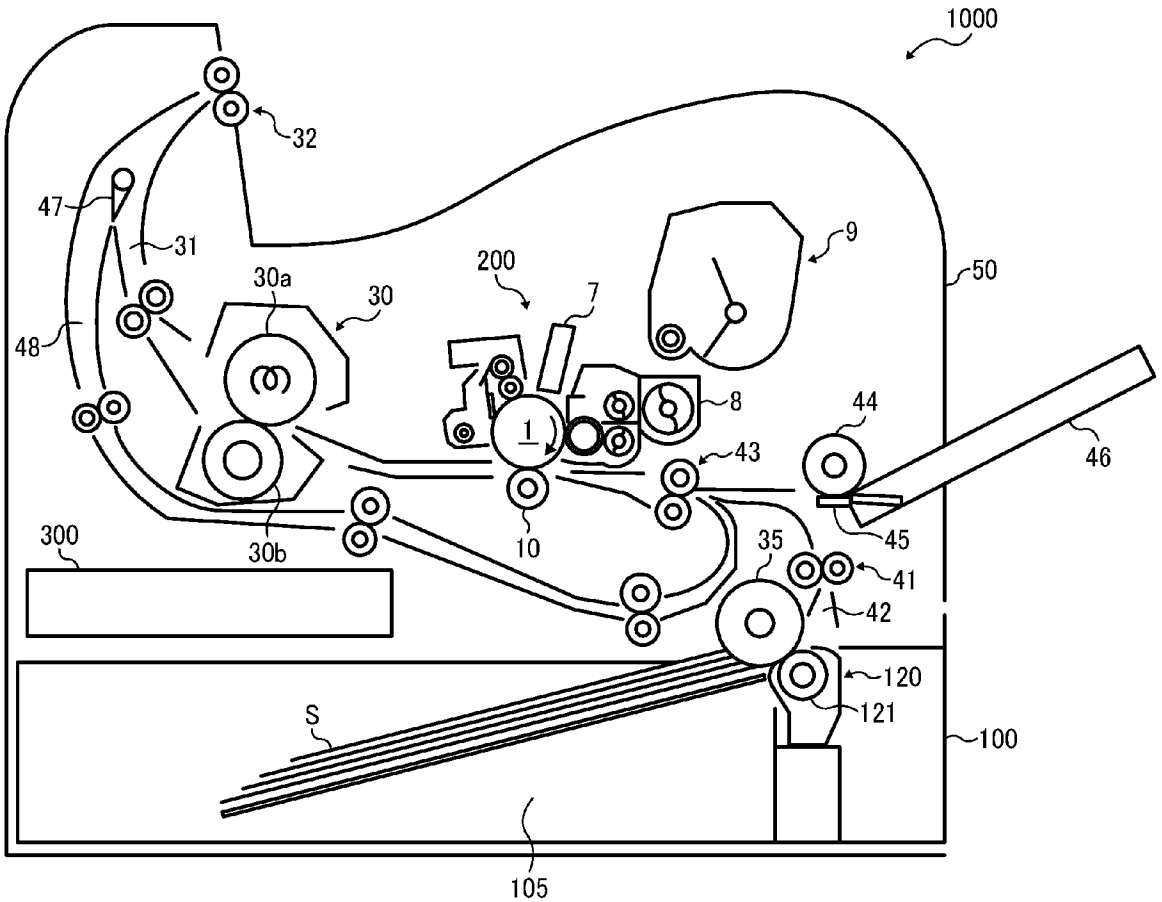
FIG. 1 is a diagram illustrating a schematic configuration of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic image forming apparatus 1000 for forming images by electrophotography.

The image forming apparatus 1000 may be a copier, a printer, a scanner, a facsimile machine, a plotter, and a multifunction peripheral or a multifunction printer (MFP) having at least one of copying, printing, scanning, facsimile, and plotter functions, or the like. According to the present example, the image forming apparatus 1000 is an electrophotographic printer that forms toner images on a sheet or sheets by electrophotography.

More specifically, the image forming apparatus 1000 functions as a printer. However, the image forming apparatus 1000 can expand its function as a copier by adding a scanner as an option disposed on top of an apparatus body of the image forming apparatus 1000. The image forming apparatus 1000 can further obtain functions as a facsimile machine by adding an optional facsimile substrate in the apparatus body of the image forming apparatus 1000.

Further, this disclosure is also applicable to image forming apparatuses adapted to form images through other schemes, such as known ink jet schemes, known toner projection schemes, or the like as well as to image forming apparatuses adapted to form images through electro-photographic schemes.

Further, it is to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, sheet member, and recording material to which the developer or ink is attracted.

At first, a description is given of a basic configuration of the image forming apparatus 1000 according to an example of this disclosure.

FIG. 1 is a diagram illustrating the image forming apparatus 1000.

In FIG. 1, the present image forming apparatus 1000 includes an apparatus body 50, a photoconductor 1 and a sheet tray 100.

The photoconductor 1 functions as a latent image carrier.

The sheet tray 100 functions as a sheet container that is detachably attachable to the apparatus body 50. The sheet tray 100 includes multiple sheets S in a form of a sheet stack.

A sheet S in the sheet tray 100 is fed from the sheet tray 100 as a sheet feed roller 35 rotates, passes through a sheet separation nip region, and reaches a sheet conveying path 42. Thereafter, the sheet S is held by a first conveying roller pair 41 in the sheet conveying nip region and is conveyed from an upstream side toward a downstream side in the sheet conveying direction in the sheet conveying path 42. A registration roller pair 43 is disposed in a vicinity of a terminal end of the sheet conveying path 42. Conveyance of the sheet S is temporarily stopped with the leading edge of the sheet S abutting against a registration nip area of the registration roller pair 43. During the abutment of the sheet S, skew of the sheet S is corrected.

The registration roller pair 43 starts driving to feed the sheet S toward the transfer nip region so as to synchronize rotation of the registration roller pair 43 with movement of the sheet S, so that the toner image formed on the surface of the photoconductor 1 is transferred onto the sheet in a transfer nip region. At this time, the first conveying roller pair 41 starts driving at the same time as the rotation of the registration roller pair 43 to resume conveyance of the sheet S that has been halted.

The apparatus body 50 of the image forming apparatus 1000 contains a bypass tray unit including a bypass tray 46, a bypass feed roller 44, and a sheet separation pad 45. The sheet S that is loaded on the bypass tray 46 of the bypass tray unit is fed from the bypass tray 46 due to rotation of the bypass feed roller 44. After passing through the sheet separation nip region formed by the bypass feed roller 44 and the sheet separation pad 45, the sheet S enters an upstream region located upstream from the registration roller pair 43 in the sheet conveying path 42 in the sheet conveying direction. Thereafter, similarly to the sheet S discharged from the sheet tray 100, the sheet S is conveyed to the transfer nip region after passing through the registration roller pair 43.

Figure 2:
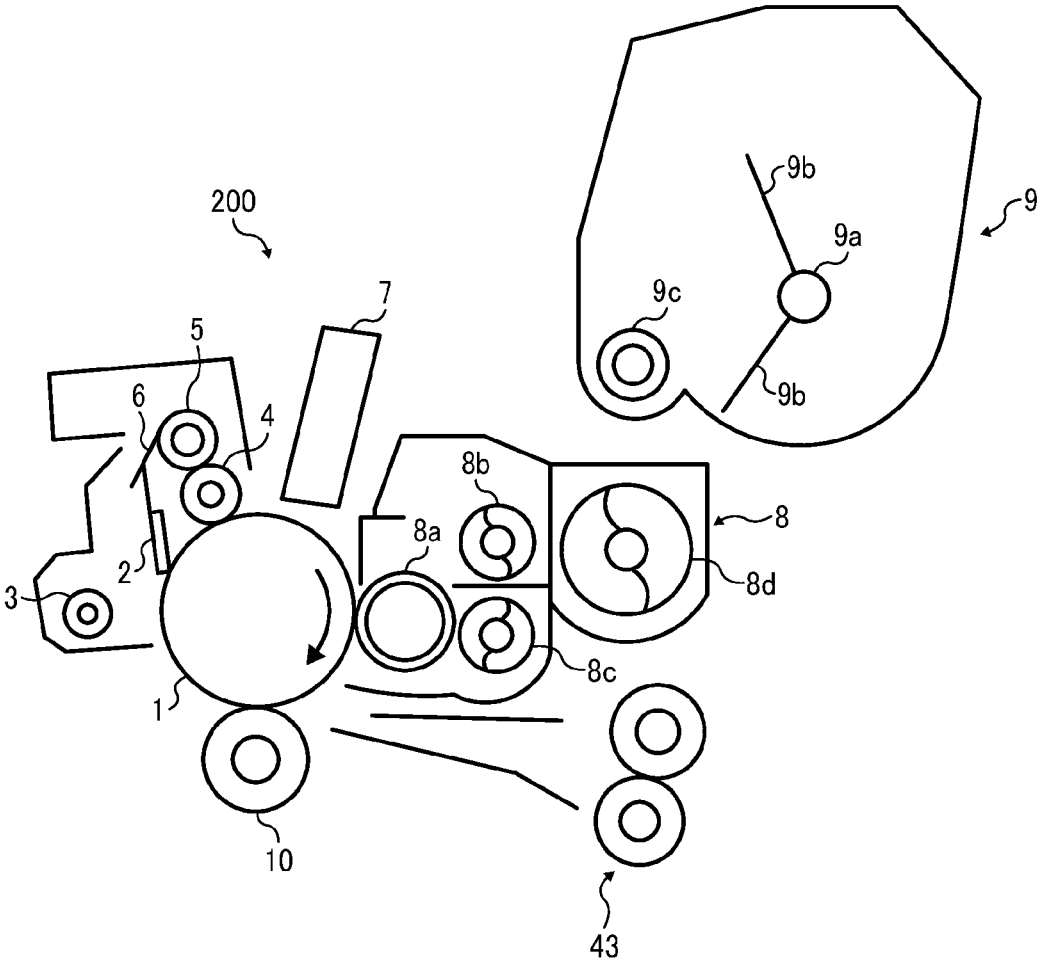
FIG. 2 is an enlarged view illustrating an image forming part including a photoconductor and image forming units disposed around the photoconductor included in the image forming apparatus of FIG. 1.

FIG. 2 is an enlarged view illustrating an image forming part 200 including the photoconductor 1 and image forming devices disposed around the photoconductor 1 included in the image forming apparatus 1000 of FIG. 1.

The photoconductor 1 is a drum-shaped photoconductor that rotates clockwise in FIG. 2. The image forming devices disposed around the photoconductor 1 are a toner collection screw 3, a cleaning blade 2, a charging roller 4, a latent image writing device 7, a developing device 8, a transfer roller 10, and the like.

The charging roller 4 includes a conductive rubber roller and forms a charging nip region by rotating while being in contact with the photoconductor 1. A charging bias that is outputted from a power source is applied to the charging roller 4. Thus, in the charging nip region, an electrical discharge is induced between the surface of the photoconductor 1 and a surface of the charging roller 4. As a result, the surface of the photoconductor 1 is uniformly charged.

The latent-image writing device 7 includes an LED array and performs light scanning with LED light over the surface of the photoconductor 1 that has been uniformly charged. On a ground surface of the photoconductor 1 that has been uniformly charged, the area having been subjected to the light irradiation through this light scanning attenuates the electric potential therein. This results in formation of an electrostatic latent image on the surface of the photoconductor 1.

As the photoconductor 1 rotates, the electrostatic latent image passes through a development region that is located facing the developing device 8.

The developing device 8 includes a circulation conveying portion and a developing portion. The circulation conveying portion accommodates developer containing toner and magnetic carriers. The circulation conveying portion includes a first screw **8*b* for conveying the developer to be supplied to a developing roller 8*a*, and a second screw 8*c* for conveying the developer in an independent space positioned beneath the first screw 8*b*. Further, the circulation conveying portion includes an inclined screw 8*d* for receiving the developer from the second screw 8*c* and supplying the developer to the first screw 8*b*. The developing roller 8*a*, the first screw 8*b*, and the second screw 8*c* are placed at attitudes parallel with each other. By contrast, the inclined screw 8*d* is placed at an attitude inclined with respect to the developing roller 8*a*, the first screw 8*b*, and the second screw 8*c***.

The first screw **8*b* conveys the developer from a distal side toward a proximal side in a direction perpendicular to the drawing sheet of FIG. 2 as the first screw 8*b* rotates. At this time, the first screw 8*b* supplies a portion of the developer to the developing roller 8*a* that is disposed opposite to the first screw 8*b*. The developer having been conveyed by the first screw 8*b* to the vicinity of a proximal end portion of the first screw 8*b* in the direction perpendicular to the drawing sheet of FIG. 2 is dropped onto the second screw 8*c***.

The second screw **8*c* receives used developer from the developing roller 8*a* and at the same time conveys the received developer from the distal side toward the proximal side in the direction perpendicular to the drawing sheet of FIG. 2 as the second screw 8*c* rotates. The developer conveyed by the second screw 8*c* to the vicinity of the end portion thereof that is close in the direction perpendicular to the drawing sheet of FIG. 2 is supplied to the inclined screw 8***d*. Further, along with rotation of the inclined screw 8*d*, the developer is conveyed from the proximal side toward the distal side in the direction perpendicular to the drawing sheet of FIG. 2. Thereafter, the developer is supplied to the first screw 8*b* in the vicinity of the distal end portion thereof in the direction perpendicular to the drawing sheet of FIG. 2.

The developing roller 8*a* includes a rotatable developing sleeve and a magnet roller. The rotatable developing sleeve is a tubular-shaped non-magnetic member. The magnet roller is fixed to the developing sleeve in such a way as not to rotate together with the developing sleeve. Further, the developing roller 8*a* takes up a portion of the developer that is conveyed by the first screw 8*b* onto the surface of the developing sleeve due to a magnetic force generated by the magnet roller. The developer that is carried on the surface of the developing sleeve passes through an opposite position facing a doctor blade. At this time, the thickness of a layer of the developer on the surface of the developing sleeve is restricted while the developer is rotated together with the surface of the development sleeve. Thereafter, the developing roller 8*a* moves while sliding against the surface of the photoconductor 1 in the developing area in which the developing roller 8*a* faces the photoconductor 1.

A development bias having the same polarity as the toner and an electric potential at the surface of the photoconductor 1 is applied to the developing sleeve. The absolute value of this development bias is greater than the absolute value of electric potential of the latent image and is smaller than the absolute value of the electric potential at the surface. Therefore, in the development area, a development potential acts between the developing sleeve and the electrostatic latent image formed on the photoconductor 1 in such a way as to electrostatically move the toner from the developing sleeve to the latent image. By contrast, a background potential acts between the development sleeve and the ground surface of the photoconductor 1 to electrostatically move the toner from the background surface to the developing sleeve. This causes the toner to selectively adhere to the electrostatic latent image formed on the photoconductor 1, so that the electrostatic latent image is developed in the development area.

The developer that has passed through the development area enters an opposite area in which the developing sleeve faces the second screw 8*c* as the developing sleeve rotates. In the opposite area, a repulsive magnetic field is formed by two magnetic poles having polarities different from each other out of multiple magnetic poles included in the magnet roller. The developer that has entered the opposite area is separated from the surface of the developing sleeve and is collected by the second screw 8*c* due to the effect of the repulsive magnetic field.

The developer that is conveyed by the inclined screw 8*d* contains the developer that has been collected from the developing roller 8*a*, and this developer is contributed to development in the development area, so that the toner concentration is lowered. The developing device 8 includes a toner concentration sensor for detecting the toner concentration of the developer to be conveyed by the inclined screw 8*d*.

Based on detection results obtained by the toner concentration sensor, a controller 300 outputs a replenishment operation signal for replenishing the toner to the developer that is conveyed by the inclined screw 8*d*, as required.

A toner cartridge 9 is disposed above the developing device 8 and includes a rotary shaft 9*a*, agitators 9*b*, and a toner replenishment member 9*c*, as illustrated in FIG. 2. The toner cartridge 9 agitates the toner contained therein with the agitators 9*b* fixed to the rotary shaft 9*a*. Further, the toner replenishment member 9*c* is driven to rotate according to the replenishment operation signal outputted from the controller 300. With this operation, the toner in an amount corresponding to a rotation amount of the toner replenishment member 9*c* is replenished to the inclined screw 8*d* of the developing device 8.

The toner image formed on the photoconductor 1 as a result of the development enters the transfer nip region where the photoconductor 1 and the transfer roller 10 that functions as a transfer device contact each other as the photoconductor 1 rotates. A charging bias having the opposite polarity to the latent image electric potential of the photoconductor 1 is applied to the transfer roller 10. Accordingly, an electric field is formed in the transfer nip region.

As described above, the registration roller pair 43 conveys the sheet S toward the transfer nip region in synchronization with a timing at which the toner image formed on the photoconductor 1 is overlaid onto the sheet S in the transfer nip region. The toner image formed on the photoconductor 1 is transferred onto the sheet S that is closely contacted to the toner image in the transfer nip region due to the actions of the electric field in the transfer nip region and the nip pressure.

Residual toner that is not transferred onto the sheet S remains on the surface of the photoconductor 1 after having passed through the transfer nip region. The residual toner is scraped off from the surface of the photoconductor 1 by the cleaning blade 2 that is in contact with the photoconductor 1 and, thereafter, is transmitted toward an outside of a unit casing by the collection screw 3. The residual toner that is removed from the unit casing is transported to a waste toner bottle by a conveying device.

The surface of the photoconductor 1 that is cleaned by the cleaning blade 2 is electrically discharged by an electric discharging device. Thereafter, the surface of the photoconductor 1 is uniformly charged again by the charging roller 4. Foreign materials such as toner additive agents and the toner that has not been removed by the cleaning blade 2 adhere to the charging roller 4 that is in contact with the surface of the photoconductor 1. These foreign materials are shifted to a cleaning roller 5 that is in contact with the charging roller 4. Thereafter, the foreign materials are scraped off from the surface of the cleaning roller 5 by a scraper 6 that is in contact with the cleaning roller 5. The foreign materials scraped off from the surface of the cleaning roller 5 falls onto the toner collection screw 3.

In FIG. 1, the sheet S that has passed through the transfer nip region formed by the photoconductor 1 and the transfer roller 10 contacting each other is conveyed to a fixing device 30. The fixing device 30 includes a fixing roller 30*a* and a pressure roller 30*b*. The fixing roller 30*a* includes a heat generating source such as a halogen lamp. The pressure roller 30*b* is pressed against the fixing roller 30*a*. The fixing roller 30*a* and the pressure roller 30*b* contacting each other form a fixing nip region. The toner image is fixed to the surface of the sheet S that is held in the fixing nip region due to application of heat and pressure. Thereafter, the sheet S that has passed through the fixing device 30 passes through a sheet discharging path 31. Then, the sheet S is held in a sheet discharging nip region of a sheet discharging roller pair 32.

The image forming apparatus 1000 according to this example can switch or change modes between a single side printing mode and a duplex printing mode. The single side printing mode is a mode to form images on a single surface of each sheet S. The duplex printing mode is a mode to form images on both sides of each sheet S. In a case in which the single side printing mode is selected or in a case in which the duplex printing mode is selected when images have already been formed on both sides of the sheet S, the sheet discharging roller pair 32 is continuously driven to rotate in a forward direction. By so doing, the sheet S in the sheet discharging path 31 is discharged to an outside of the image forming apparatus 1000. The discharged sheet S is stacked in a stack portion provided on the upper surface of the apparatus body 50.

By contrast, when an image is formed on one side (i.e., a front face) of the sheet S in the duplex printing mode, the sheet discharging roller pair 32 is driven to reversely rotate at the timing when the end portion (e.g., the leading end) of the sheet S enters the sheet discharging nip region formed by the pair of the sheet discharging roller pair 32. At this time, a separating claw 47 that is disposed in the vicinity of an terminal end of the sheet discharging path 31 is activated to close the sheet discharging path 31 and open an entrance of a sheet reverse reentry path 48. The sheet S starts moving in a reverse direction to the sheet conveying direction as the sheet discharging roller pair 32 rotates reversely. Then, the sheet S is conveyed into the sheet reverse reentry path 48. Further, the sheet S is conveyed while being reversed upside down through the sheet reverse reentry path 48, and then is conveyed to the registration nip region of the registration roller pair 43 again. Then, after the toner image is transferred onto the other side (e.g., a reverse side) in the transfer nip region, the sheet S passes through the fixing device 30, the sheet discharging path 31, and the sheet discharging roller pair 32 to be discharged to the outside of the image forming apparatus 1000.

Now, a description is given of sheet trays provided to a comparative image forming apparatus according to comparative examples, with FIGS. 3 through 10.

Figure 3:
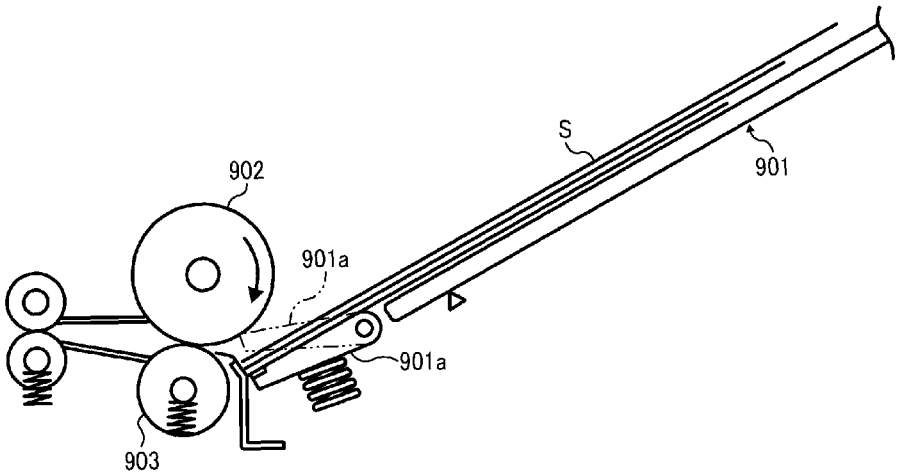
FIG. 3 Conventional Art
FIG. 3 is a diagram illustrating a comparative bypass tray included in a comparative image forming apparatus.

FIG. 3 is a structural view illustrating a bypass tray in the comparative image forming apparatus. In FIG. 3, a sheet feed roller 902 and a sheet separation roller 903 contact each other to form a sheet separation nip region on the side of a bypass tray 901 that accommodates multiple sheets S in a state of a sheet stack. A movable plate 901*a* is provided at the leading end portion of the bypass tray 901 and is biased by a spring. By so doing, the leading end portions of the sheets S on the bypass tray 901 to abut against the sheet feed roller 902. When the sheet feed roller 902 is driven to rotate, a sheet S is fed from the bypass tray 901.

A torque limiter is disposed to support a rotary shaft of the sheet separation roller 903. Specifically, the torque limiter is coupled to a rotary shaft of the sheet separation roller 903.

If the sheet separation roller 903 that is directly in contact with the sheet feed roller 902 is rotated together with the sheet feed roller 902, a rotation torque exceeding a predetermined threshold value is induced to the rotary shaft member of the sheet separation roller 903. Thus, the torque limiter permits the sheet separation roller 903 to be rotated with the sheet feed roller 902 in a direction in which the sheet separation roller 903 follows rotation of the sheet feed roller 902.

In some cases, multi-feed may be induced. The multi-feed is a defect operation in which two or more sheets S are fed from the sheet tray 901 along with rotation of the sheet feed roller 902. If two or more sheets S are held by the sheet separation nip region due to the multi-feed, the sheet S that is directly in contact with the sheet feed roller 902 in the sheet stack of the sheets S is conveyed in a sheet feeding direction as a surface of the sheet feed roller 902 moves. At this time, this uppermost sheet S is moved while slipping on the surface of a subsequent sheet S or a second sheet S.

Due to this slipping, the rotation torque of the sheet separation roller 903, to which a rotating force is applied from the sheet feed roller 902 via the multiple sheets S interposed therebetween, is reduced to a value below the previously described threshold value.

Further, the torque limiter transmits a reverse-rotation driving force from a drive motor to the sheet separation roller 903. This causes the sheet separation roller 903 to start rotating reversely, so that the second sheet S and the other sheets S of the sheet stack are conveyed backwardly toward the bypass tray 901.

Through this backward conveyance, even in the event of the multi-feed, the sheet S that is directly in contact with the sheet feed roller 902 is separated therefrom and is transmitted to an image forming device constituted by a photoconductor and the like for forming images through known electrophotographic processing.

As a component for feeding the sheets placed in a sheet container such as a tray toward an image forming device, it is general to employ a pickup roller provided besides a sheet feed roller and a sheet separation roller.

However, the image forming apparatus described in this comparative example does not include a pickup roller and causes the sheet feed roller 902 to function as a pickup roller. With this structure, a reduction in cost can be achieved without a pickup roller.

As a component for accommodating a stack of sheets, known sheet trays are employed as well as bypass trays as illustrated in FIG. 3. Such known sheet trays are generally detachably attached to an apparatus body of an image forming apparatus and accommodate a larger amount of sheets than those in bypass trays. Such sheet trays can achieve cost reduction by employing a configuration in which sheets loaded in the sheet tray(s) are pressed against a sheet feed roller without a pickup roller (hereinafter, referred to as a pickup-less structure), similarly to the bypass tray 901 illustrated in FIG. 3.

Figure 4:
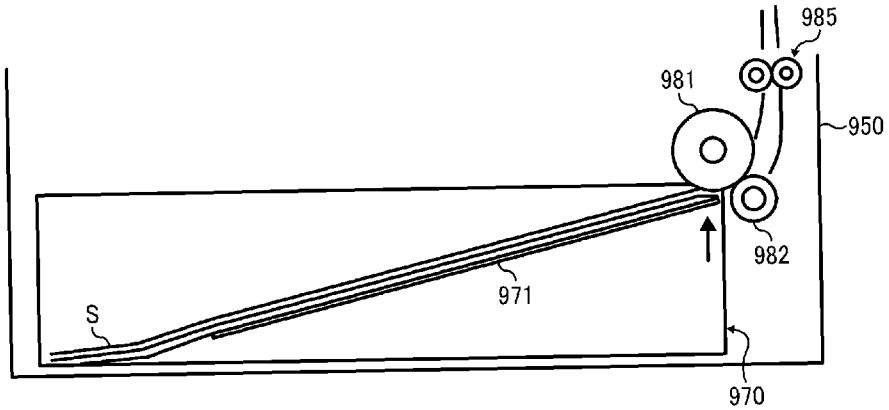
FIG. 4 Conventional Art
FIG. 4 is a diagram illustrating a schematic configuration of another comparative configuration of a sheet tray having a pickup-less structure, and units disposed around the sheet tray.

FIG. 4 is a schematic structural view illustrating another comparative configuration of a sheet tray having a pickup-less structure, and units disposed around the sheet tray.

In FIG. 4, the sheet tray 970 that accommodates a stack of sheets S therein is detachably attached to the apparatus body 950 in the image forming apparatus. By contrast, a sheet feed roller 981 and a sheet separation roller 982 are rotatably fixed to an inside of the apparatus body 950. The leading end portions of the sheets S loaded in the sheet tray 970 are pressed against the sheet feed roller 981 by a movable plate 971. Due to this pressing, the sheet feed roller 981 functions as a member for feeding the sheets S loaded in the sheet tray 970 toward the sheet feeding path without using a pickup roller. By so doing, a cost reduction of the image forming apparatus can be achieved.

However, this configuration is likely to tear a jammed sheet when the jammed sheet is removed for eliminating a paper jam. More specifically, a jammed sheet generated in a vicinity of the sheet separation nip region is generally in a state in which a leading end thereof is held in a sheet conveying nip region of a sheet conveying roller pair 980 that exists downstream from the sheet separation nip region and a trailing end thereof is held in the sheet separation nip region. To remove the jammed sheet, an opening is provided on any one of four sidewalls in the apparatus body 50 having a rectangular shape, so that a user can insert the hand through the opening to remove the jammed sheet from the apparatus body 950. Further, an opening is provided on any one of the four sidewalls in the apparatus body 950, so that the user can pull out the sheet tray 970 from the apparatus body 950. In order to reduce a size of the apparatus body 950 and the number of units and members in the sheet tray 970 and the apparatus body 950, it is general to provide the opening for removing the sheet tray 970 from the apparatus body 950 is also used as the opening for inserting the hand of the user. In the image forming apparatus illustrated in FIG. 4, if the sheet tray 970 is pulled out from the apparatus body 950 by sliding and moving the sheet tray 970 from a left side to a right side in FIG. 4, the sheet tray 970 is caught by the sheet separation roller 982. Therefore, the sheet tray 970 is not pulled out in a left-to-right direction in FIG. 4.

Further, in a case in which the sheet tray 970 is pulled out from the apparatus body 950 by sliding and moving the sheet tray 970 from the right side to the left side in FIG. 4, the opening is provided in a left sidewall of the four sidewalls in the apparatus body 950. It is significantly difficult for a user to stretch his/her hand inserted through this opening to the trailing end of the jammed sheet existing in the vicinity of the sheet separation nip region at substantially an opposite position from the opening. Accordingly, it is not practical to employ the above-described configuration.

As a result thereof, it is considered that it is general to employ a configuration in which the sheet tray 970 is pulled out from the inside of the apparatus body 950 by sliding and moving the sheet tray 970 in the direction orthogonal to a sheet face of FIG. 4.

However, with this configuration, the opening is provided on a front sidewall or a rear sidewall of the four sidewalls in a direction orthogonal to the paper plane of FIG. 4. The user inserting his/her hand into the apparatus body 950 through this opening can grasp the jammed sheet at one end thereof in the direction orthogonal to the sheet conveying direction of the jammed sheet. Accordingly, when the jammed sheet is pulled out from the sheet separation nip region with the one end of the jammed sheet being grasped, the user tends to exert a concentrated pulling force to the one end thereof, so that the jammed sheet is easily torn.

The sheet tray is provided with a sheet containing unit and a sheet separating roller storing unit. The sheet containing unit accommodates recording media S as a sheet stack. The sheet separating roller storing unit is disposed at one end of the sheet containing unit and stores the sheet separating roller 982. The sheet tray 970 integrally including the sheet containing unit and the sheet separating roller storing unit is detachably attachable to the apparatus body 950. According to this configuration, a positional relation between the sheet separating roller 982 and the sheet tray 970 does not cause any poor operation of the image forming apparatus.

The sheet tray 970 illustrated in FIG. 4 is moved together with the sheet separating roller 982 from the left side to the right side in FIG. 4. After the sheet tray 970 is pulled out as described above, an opening of space generated in the apparatus body 950 is formed in one sidewall of the four sidewalls of the apparatus body 950. The sidewall having the opening is, for example, a right sidewall of the apparatus body 950 illustrated in FIG. 4 that extends in a direction parallel to a face that is perpendicular to a tray detaching direction in the vicinity of the sheet separation nip region. The opening formed in this sidewall is disposed facing a surface of the jammed sheet that remains in the apparatus body 950.

At this time, the sheet separating roller 982 is pulled out from the apparatus body 950 together with the sheet tray 970, and therefore the sheet separation nip region is released. However, the jammed sheet is kept by a sheet conveying device that includes a sheet conveying roller pair that is disposed downstream from the sheet feed roller 981 in a sheet conveying direction, and therefore remains in the apparatus body 950.

Further, the opening that is formed in the above-described sidewall is disposed facing the surface of the jammed sheet, so that the jammed sheet exposes both end portions thereof to the outside of the apparatus body 950 in a direction perpendicular to the sheet conveying direction. The user grasps one end portion of the jammed sheet with one hand inserted through this opening while grasping the other end portion of the jammed sheet with the other hand also inserted through the opening. Further, the user takes out the jammed sheet to the outside of the apparatus body 950 while pulling out the jammed sheet from the sheet conveying device with both hands. At this time, respective pulling forces are applied to the end portions of the jammed sheet. Accordingly, concentrations of the respective pulling forces applied to both end portions of the jammed sheet are restrained more than concentration of the pulling force applied to one end portion of the jammed sheet. As a result, the jammed sheet is prevented from being torn.

However, the sheet tray 970 illustrated in FIG. 4 does not include a driving transmission system to apply a reverse rotation driving force. If a torque acting on the sheet separating roller 982 is below a given threshold value, a torque limiter does not allow reverse rotation of the sheet separating roller 982 but prevents the sheet separating roller 982 from rotating. When the sheet separating roller 982 is stopped, a greater conveyance resistance is applied to the sheet S in comparison with a conveyance resistance that is applied when the sheet separating roller 982 rotates with the sheet that does not directly contact the sheet feed roller 981. As a result, movement of the sheet S stops in the sheet separation nip region. Accordingly, the sheet S that is directly in contact with the sheet feed roller 981 is fed in the sheet conveying direction.

Figure 5:
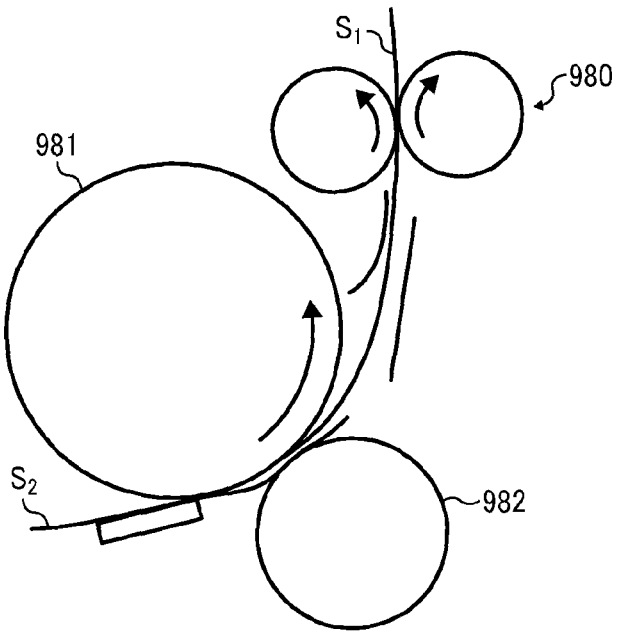
Conventional Art FIG. 5
FIG. 5 is a diagram illustrating a state in which a preceding sheet is separated in a sheet separation nip region provided to the comparative image forming apparatus.

It is assumed that two sheets, e.g., a preceding sheet S1 and a subsequent sheet S2, are held in the sheet separation nip region due to multi feed as illustrated in FIG. 5. The leading end of the preceding sheet S1 that is fed through the sheet separation nip region is held in a sheet conveyance nip region that is formed between a sheet conveying roller pair 980. The sheet conveying roller pair 980 is disposed in a sheet conveying path. At this time, the trailing end of the preceding sheet S1 remains in the sheet separation nip region formed between the sheet feed roller 981 and the sheet separating roller 982. Thereafter, the trailing end of the preceding sheet S1 passes through the sheet separation nip region, and the subsequent sheet S2 that has not been in contact with the sheet feed roller 981 is brought into directly contact with the sheet feed roller 981. At this time, if the sheet feed roller 981 is driven to rotate, the subsequent sheet S2 is discharged from the sheet separation nip region, and therefore movement of the subsequent sheet S2 cannot be informed. Therefore, the rotation of the sheet feed roller 981 is stopped at a timing slightly earlier than the timing when the trailing end of the preceding sheet S1 passes through the sheet separation nip region. Even though the rotation of the sheet feed roller 981 is stopped as described above, the leading end of the preceding sheet S1 is held by the sheet conveying roller pair 980 and a sheet conveying force is applied. Therefore, the preceding sheet S1 can pass out of the sheet separation nip region.

At the moment the trailing end of the preceding sheet S1 passes out of the sheet separation nip region, the sheet separating roller 982 that is biased toward the sheet feed roller 981 is displaced toward the sheet feed roller 981 by an amount corresponding to the thickness of the preceding sheet S1. This action causes the subsequent sheet S2 to abut against the sheet feed roller 981. At this time, it is likely that the sheet feed roller 981 that is stopped and free from rotation can rotate in a direction opposite to the sheet conveying direction due to impact induced when the subsequent sheet S2 is pressed against the sheet feed roller 981. Hereinafter, the rotation of the sheet feed roller 981 caused by the above-described action is referred to a "slight reverse rotation".

Figure 6:
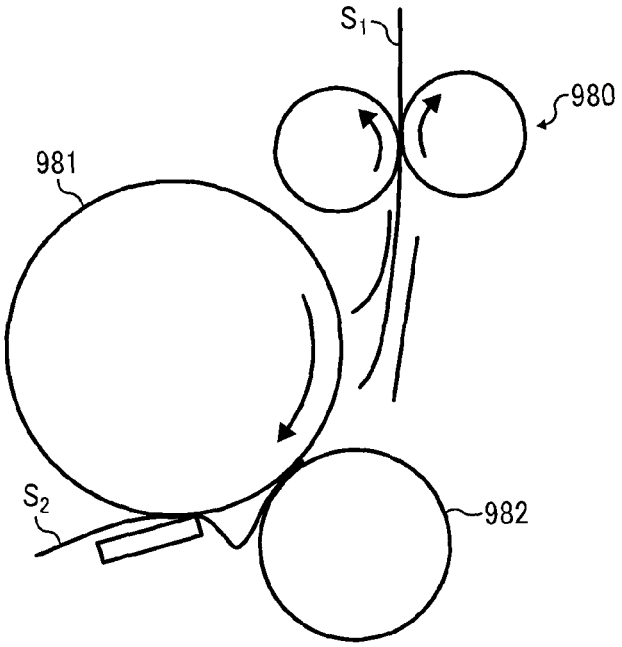
FIG. 6 Conventional Art
FIG. 6 is a diagram illustrating a warp formed on a subsequent sheet due to slight reverse rotation of the sheet feed roller in the comparative image forming apparatus.
Figure 7:
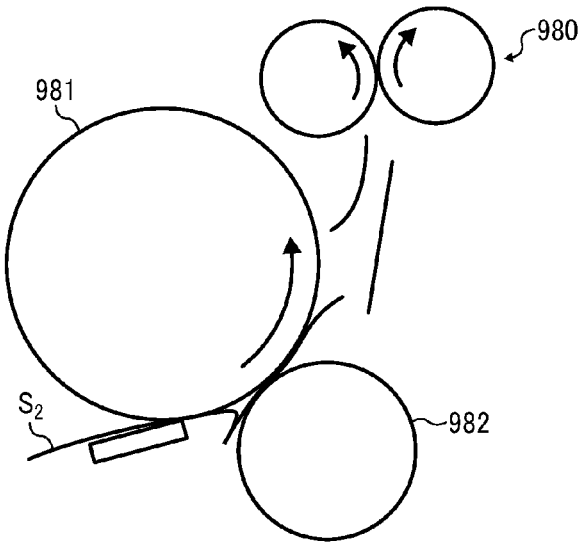
FIG. 7 Conventional Art
FIG. 7 is a diagram illustrating how crease is generated when the warp enters the sheet separation nip region.

Then, when the subsequent sheet S2 is a thin paper having a smaller rigidity, e.g., a paper sheet of 52 g/m$^2$, the leading end of the subsequent sheet S2 is returned toward the sheet tray 970 following the slight reverse rotation of the sheet feed roller 981, as illustrated in FIG. 6. This induces warp in a region adjacent to the leading end of the subsequent sheet S2 as illustrated in FIG. 6. If the sheet feed roller 981 is driven to rotate again while the leading end of the subsequent sheet S2 is warped, the warp of the subsequent sheet S2 is sandwiched by the sheet feed roller 981 and the sheet separating roller 982 in the sheet separation nip region, as illustrated in FIG. 7. Consequently, crease is generated in the subsequent sheet S2.

Further, when two or more sheets are fed simultaneously, which is referred to as multi feed, the preceding sheet S1 is conveyed from the sheet separation nip region and the subsequent sheet S2 remains in the sheet separation nip region. If a printing job is completed in this state and the sheet tray 970 is removed for some reasons from the apparatus body 950 with the subsequent sheet S2 held in the sheet separation nip region, the leading end of the subsequent sheet S2 is placed on the sheet separating roller 982 that functions as a sheet separating rotary body in the sheet tray 970.

Figure 8:
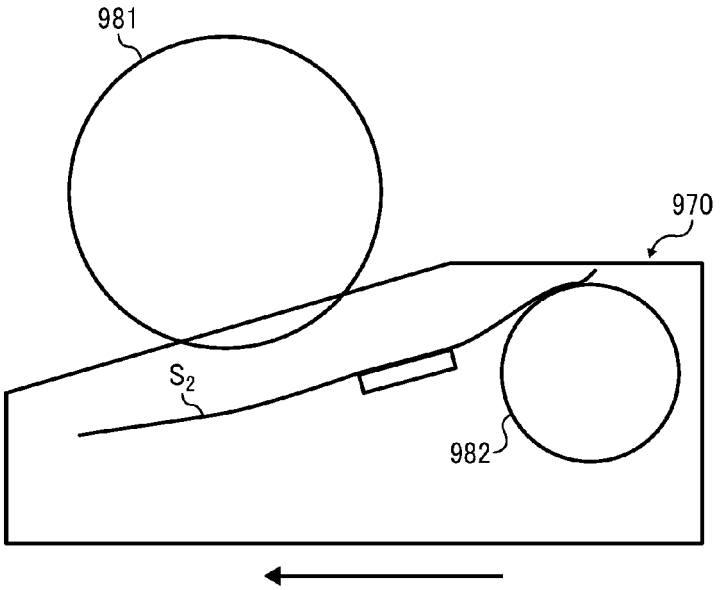
FIG. 8 Conventional Art
FIG. 8 is a diagram illustrating the sheet feed roller and peripheral units when the sheet tray is inserted into the apparatus body.
Figure 9:
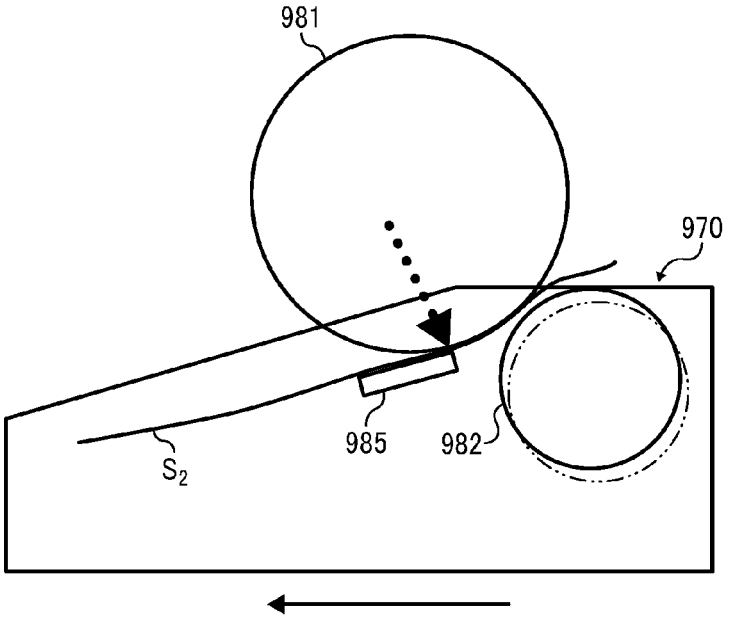
FIG. 9 Conventional Art
FIG. 9 is a diagram illustrating the sheet feed roller and the peripheral units when the sheet tray is halfway in the apparatus body.

If the sheet tray 970 in this state is inserted into the apparatus body 950 in a direction indicated by a solid arrow illustrated in FIGS. 8 and 9, the subsequent sheet S2 is sandwiched between a tip end of a pad 985 of the sheet tray 970 and the sheet feed roller 981 in the apparatus body 950 as indicated by a dotted arrow illustrated in FIG. 9. The pad 985 is provided for pressing the leading end of the sheet S accommodated in the sheet tray 970 against the sheet feed roller 981.

In FIG. 9, the sheet tray 970 has not yet completely moved to a setting position thereof in the apparatus body 950. Therefore, the sheet tray 970 is further inserted into the apparatus body 950. Then, along with movement of the sheet tray 970, the pad 985 in the sheet tray 970 moves. At this time, the subsequent sheet S2 is dragged on a circumferential surface of the sheet feed roller 981. Therefore, a contact position of the pad 985 with the sheet feed roller 981 on the subsequent sheet S2 is not largely changed.

Figure 10:
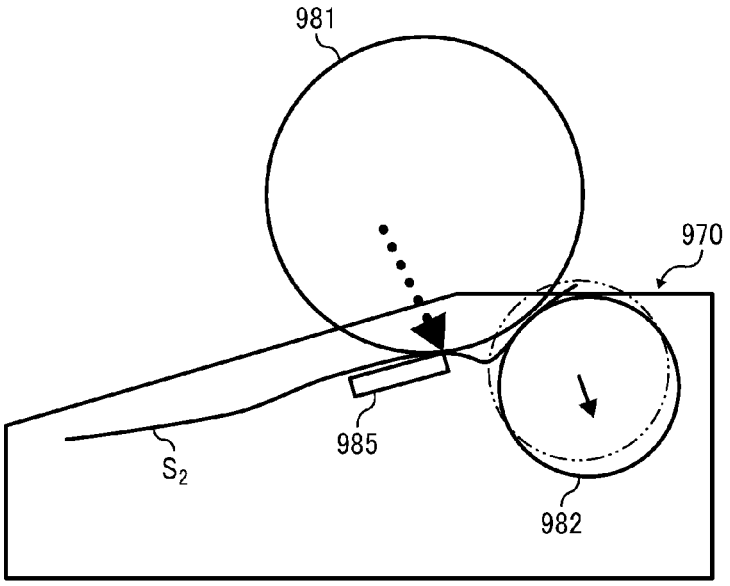
FIG. 10 Conventional Art
FIG. 10 is a diagram illustrating the sheet feed roller and the peripheral units immediately after the sheet tray is completely set.

When the sheet tray 970 is further inserted into the apparatus body 950, an area of the subsequent sheet S2 on the sheet separating roller 982 contacts the circumferential surface of the sheet feed roller 981. The sheet tray 970 in this state is pushed into the apparatus body 950, the sheet separating roller 982 is pressed down by the sheet feed roller 981 in such a way as to push aside the sheet feed roller 981. At this time, the sheet feed roller 981, the subsequent sheet S2 that moves together with the sheet separating roller 982 applies a force in a direction of reverse rotation of the sheet feed roller 981. However, the reverse rotation is prevented by the one-way clutch. Therefore, the area of the subsequent sheet S that is held by the sheet feed roller 981 and the sheet separating roller 982 also moves together with the sheet separation roller 982 while the subsequent sheet S is dragged on the circumferential surface of the sheet feed roller 981. Then, as illustrated in FIG. 10, when the sheet tray 970 is moved to the setting position thereof, the subsequent sheet S2 is warped at a position between the sheet feed roller 981 and the sheet separating roller 982. Further, the warp is held in the sheet separation nip region when the sheet feed roller 981 rotates, and therefore crease is generated in the subsequent sheet S2.

Further, it has been confirmed through experiments that, when no one-way clutch is provided to the sheet feed roller 981, generation of crease is prevented. Specifically, when any one-way clutch is not provided to the sheet feed roller 981, the sheet feed roller 981 rotates with the sheet separating roller 982 as the sheet separating roller 982 in contact with the sheet feed roller 981 moves to the left side in FIG. 8 due to insertion of the sheet tray 970 to the apparatus body 950. With the sheet feed roller 981 rotating with the sheet separating roller 982, the warp as illustrated in FIG. 9 is not induced.

Next, a description is given of the detailed configuration of the image forming apparatus 1000.

Figure 11:
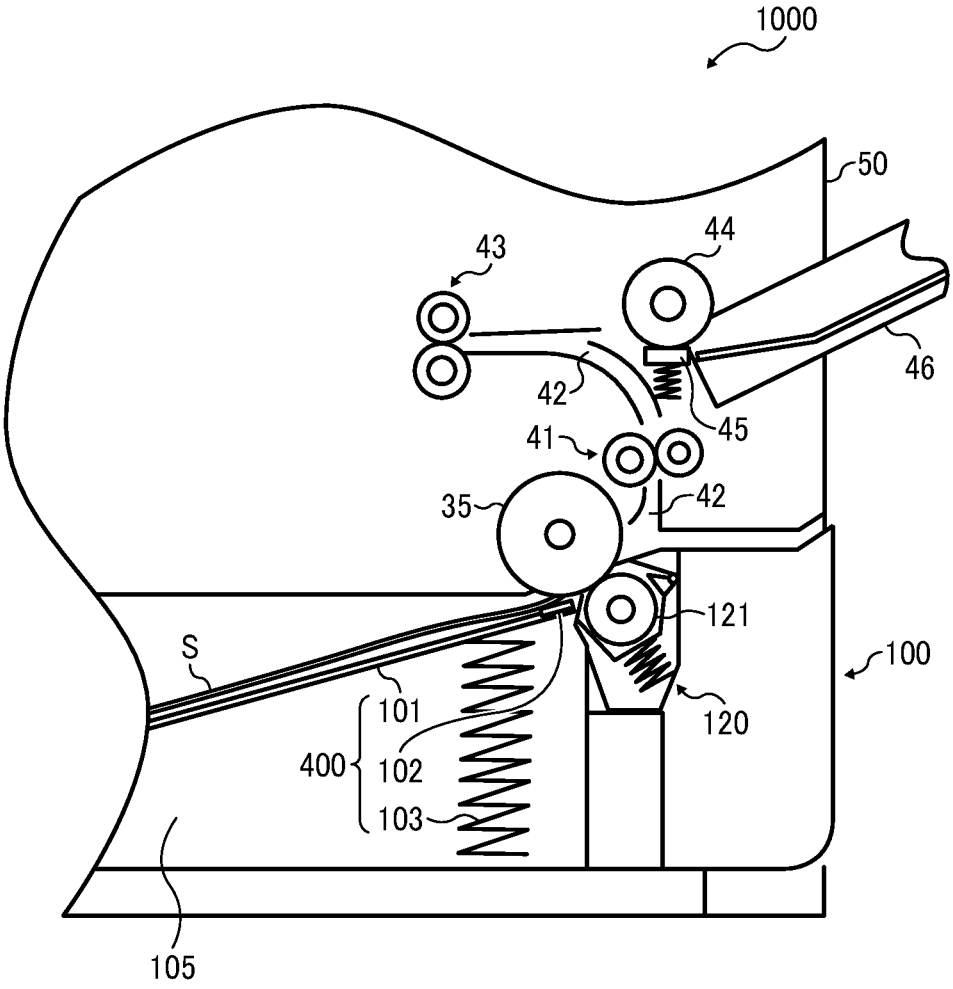
FIG. 11 is a partial enlarged view illustrating a lower part of the image forming apparatus of FIG. 1.

FIG. 11 is a partial enlarged view illustrating a lower part of the image forming apparatus 1000 of FIG. 1.

As illustrated in FIG. 11, the sheet tray 100 accommodates the sheet stack of the multiple sheets S loaded on a movable bottom plate 101. The movable bottom plate 101 is biased toward the sheet feed roller 35 by a bottom plate spring 103. A bottom plate pad 102 that is an elastic member is fixed the leading end portion of the movable bottom plate 101. The leading end portion of the sheet stack is pressed toward the sheet feed roller 35 by the force of the bottom plate spring 103 in a state in which the leading end portion of the sheet stack is sandwiched between the bottom plate pad 102 and the sheet feed roller 35.

Figure 16:
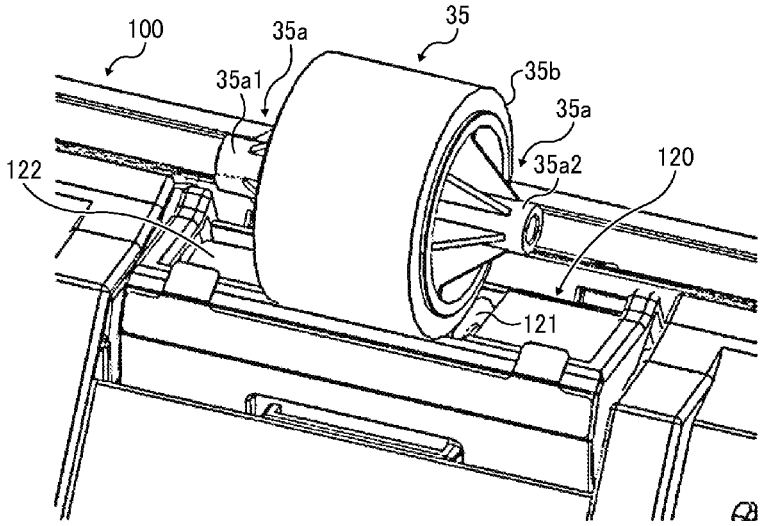
FIG. 16 is a partial perspective view illustrating a separation roller unit included in the sheet tray and a sheet feed roller fixed to an apparatus body.

The sheet feed roller 35 has a rotary shaft 35*a* (FIG. 16).

As the sheet feed roller 35 rotates, an uppermost sheet S placed on top of the sheet stack is fed from the movable bottom plate 101. Then, the uppermost sheet S enters the sheet separation nip region formed by contact of the sheet feed roller 35 and a sheet separating roller 121. The sheet feed roller 35 that functions as a sheet feeding body and the sheet separating roller 121 that functions as a sheet separating body form a sheet separating part.

In the image forming apparatus 1000, as described above, the sheets S are fed from the sheet tray 100 as the sheet feed roller 35 is driven in a state in which the sheet S is pressed against the sheet feed roller 35 by a pressing device 400 including the movable bottom plate 101, the bottom plate pad 102, and the bottom plate spring 103. This configuration can achieve cost reduction by not providing a pickup roller for the sheet tray 100.

Generally, a rotation driving force is applied to the sheet separating roller 121 for moving the surface of the sheet separating roller 121 in a direction opposite to the direction of rotation of the sheet feed roller 35, as required. However, in the image forming apparatus 1000 according to the present example, such a rotation driving force is not applied to the sheet separating roller 121. The sheet separating roller 121 rotates by following the sheet feed roller 35 and the sheets S in the sheet separation nip region.

The sheet separating roller 121 has a rotary shaft 121*a* (see FIG. 14) and a cylindrical roller part. One end of the rotary shaft 121*a* of the sheet separating roller 121 is rotatably supported by a torque limiter 122 (see FIG. 14). When the sheet S is not in the sheet separation nip region, the sheet separating roller 121 contacts the sheet feed roller 35 directly. As the sheet feed roller 35 rotates in this state, a relatively large driving force is applied from the sheet feed roller 35 to the sheet separating roller 121. According to this configuration and operation, a torque of rotation of the sheet separating roller 121 exceeds a given threshold of the torque of rotation thereof, so that the torque limiter 122 causes the sheet separating roller 121 to rotate. That is, when the sheet S is not entered in the sheet separation nip region, the sheet separating roller 121 rotates with the sheet feed roller 35.

Further, when a single sheet S enters the sheet separation nip region, there are no sheets other than the single sheet S between the sheet separating roller 121 and the sheet feed roller 35. In this state, if the sheet feed roller 35 rotates, the sheet feed roller 35 exerts a strong conveying force on the sheet S, and therefore the sheet S moves in the sheet feeding direction. At the same time, the sheet feed roller 35 exerts a relatively strong driving force on the sheet separating roller 121 via the sheet S interposed therebetween. Consequently, the torque for rotating the sheet separating roller 121 with the sheet feed roller 35 exceeds a predetermined threshold value, so that the torque limiter permits the sheet separating roller 121 to rotate with the sheet feed roller 35. Specifically, when the single sheet S exists in the sheet separation nip region, the sheet separating roller 121 rotates with the sheet feed roller 35.

By contrast, it is assumed that two or more sheets S enter the sheet separation nip region in a form of layers due to multi feed. In this case, the sheet feed roller 35 exerts a relatively strong conveying force on the uppermost sheet S that is directly in contact with the sheet feed roller 35 in the sheet separation nip region, and therefore the uppermost sheet S is conveyed in the sheet feeding direction.

Further, the remaining sheets S other than the uppermost sheet S are pressed in the sheet separation nip region, and therefore are subjected to a conveyance resistance. This conveyance resistance exceeds a frictional resistance between the uppermost sheet S and a subsequent sheet S, that is, a second sheet S. Accordingly, a slip is induced between the uppermost sheet S and the subsequent sheet S. Due to this slip, the torque for causing the sheet separating roller 121 to rotate with the sheet feed roller 35 comes to be equal to or smaller than the given threshold value, so that the torque limiter stops the sheet separating roller 121 from rotating with the sheet feed roller 35. This operation further increases the conveyance resistance exerted on the second and other subsequent sheets S. As a result, movement of the second and other subsequent sheets S is stopped. Thus, the sheet separating roller 121 exerts the conveyance resistance on the multiple sheets S and separates the uppermost sheet S from the other sheets S of the sheet stack.

This configuration separates the sheets S through the sheet separation nip region without applying a reverse rotation driving force from a motor to the sheet separating roller 121. By so doing, a driving transmission device for transmitting driving to the sheet separating roller 121 is not used, and therefore a reduction in cost can be achieved.

The torque limiter 122 functions as a rotation adjusting unit to adjust rotation of the sheet separating roller 121 that is directly in contact with the sheet feed roller 35 by allowing the sheet separating roller 121 to rotate with the sheet feed roller 35 and by preventing rotation of the sheet separating roller 121 when multiple sheets S enter the sheet separation nip region due to multi feeding.

The image forming apparatus 1000 having this configuration separates the sheets S in the sheet separation nip region without exerting a reverse-rotation driving force from a motor on the sheet separating roller 121. With this separation of the sheet S in the sheet separation nip region, a driving transmission device for transmitting driving to the sheet separating roller 121 is eliminated, thereby enabling cost reduction.

Figure 12:
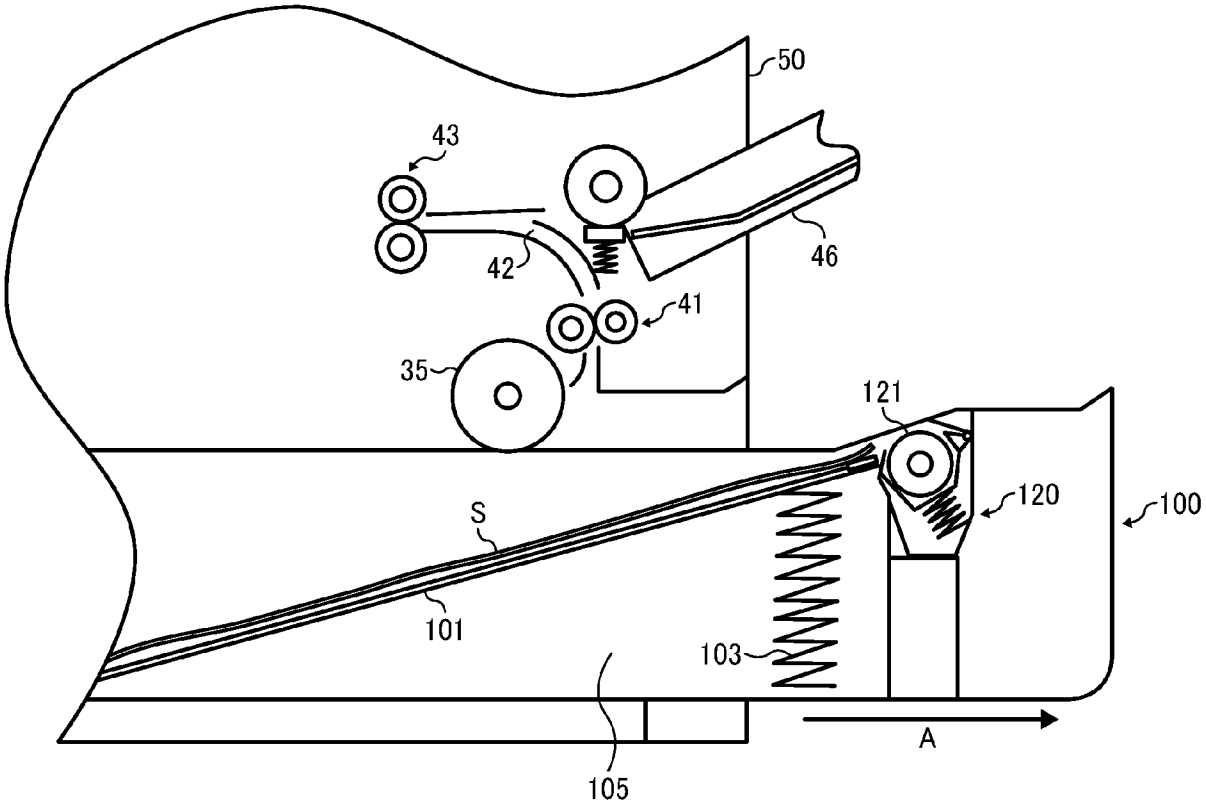
FIG. 12 is a partial enlarged view illustrating a sheet tray that is being pulled out from an apparatus body of the image forming apparatus of FIG. 1.

FIG. 12 is a partial enlarged view illustrating the sheet tray 100 that is pulled out from the apparatus body 50 of the image forming apparatus 1000.

As illustrated in FIG. 12, the image forming apparatus 1000 has the configuration in which the sheet separating roller 121 is held by the sheet tray 100 and is disposed detachably attachable to the apparatus body 50 together with the sheet tray 100. With this configuration, the sheet tray 100 can be detachably attached to the apparatus body 50 by sliding not in an axial direction of rotation of a roller such as the sheet feed roller 35 and the sheet separating roller 121 but in a left-to-right direction in FIG. 12. Since the sheet separation roller 121 moves together with the sheet tray 100, the sheet separating roller 121 does not obstruct sliding and moving of the sheet tray 100 in a direction indicated by arrow A along the left-to-right direction in FIG. 12. Hereinafter, the axial direction of rotation of a roller such as the sheet feed roller 35 and the sheet separating roller 121 is referred to as a "roller axis direction".

In the event of occurrence of a paper jam in a state in which the sheet S is being held in the sheet separation nip region, a user slides and moves the sheet tray 100 in the direction A in FIG. 12 to pull out the jammed sheet S from the apparatus body 50. Then, the sheet separating roller 121 is taken out therefrom together with the sheet tray 100, and therefore the sheet separation nip region is eliminated. However, the jammed sheet S is held in a sheet conveyance nip region formed by the first conveying roller pair 41, and, therefore remains in the apparatus body 50.

Since the sheet tray 100 is pulled out from apparatus body 50, space is generated within apparatus body 50. The space is largely opened in the direction A in FIG. 12, which is a sheet tray detaching direction. The user can easily and visually recognize the jammed sheet toward the surface thereof through this opening.

Further, the user can pull out the jammed sheet from the sheet conveyance nip region formed by the first conveying roller pair 41 while grasping the opposite end portions of the jammed sheet in the roller axis direction with his/her both hands inserted through the opening. At this time, respective pulling forces are exerted on the opposite end portions of the jammed sheet. By so doing, concentrations of the pulling forces are restrained and occurrence of tears of the jammed sheet can be substantially avoided in comparison with cases where the jammed sheet is grasped at one end portion thereof.

Accordingly, the image forming apparatus 1000 can restrain tears of jammed sheets during eliminating paper jams.

It is to be noted that the sheet tray pull-out direction of the image forming apparatus 1000 (i.e., the direction A in FIG. 12) is a direction in which the sheet tray 100 is moved from the side close to a sheet containing unit 105 toward the side close to the separation roller unit, as illustrated in FIG. 12.

Figure 13:
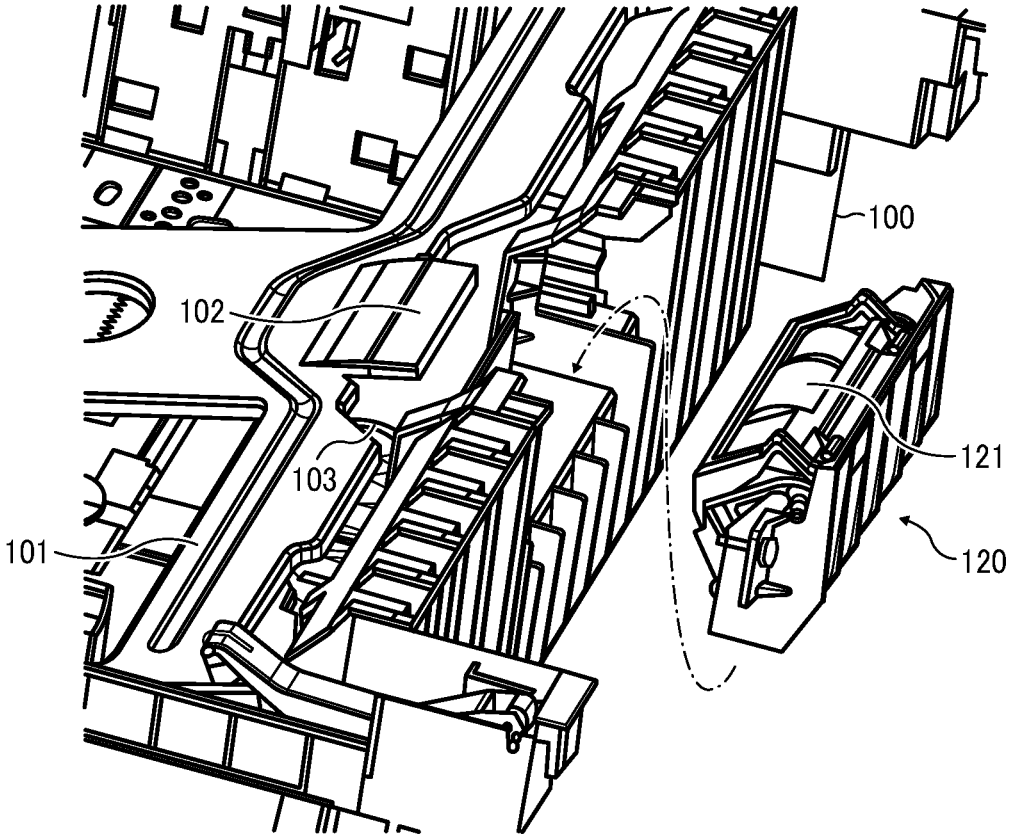
FIG. 13 is a partial perspective view illustrating the apparatus body with space therein due to withdrawal of the sheet tray of FIG. 12.

FIG. 13 is a partial perspective view illustrating the sheet tray viewed from a front side thereof. In FIG. 13, a front cover, which is a cover provided with a pulling-out handle, in the sheet tray 100 is not illustrated, for convenience.

As illustrated in FIG. 13, the sheet separating roller 121 is structured to be included in a separation roller unit 120 together with in cooperation with other several components as described below. The separation roller unit 120 that functions as a sheet separating body storing unit is integrally attached and detached with respect to a receiving portion in the sheet tray 100. Thus, by making the sheet separating roller 121 into a unit, components can be standardized with other types of image forming apparatuses. Accordingly, a cost reduction can be achieved. Specifically, sheet trays other types of image forming apparatuses having different specifications from the image forming apparatus 1000 according to this example are also adapted to have the same configuration as the sheet tray 100 in the image forming apparatus 1000. However, such sheet trays in other types of image forming apparatuses are adapted to accommodate different numbers of sheets S from the sheet tray 100 in the image forming apparatus 1000. Therefore, the sheet trays in image forming apparatuses of different types are adapted to have different thicknesses thereof. Even such sheet trays having different specifications as described above are adapted to include the separation roller units 120 having completely the identical specifications to be attached and detached. Accordingly, standardization to use common components is achieved.

Figure 14:
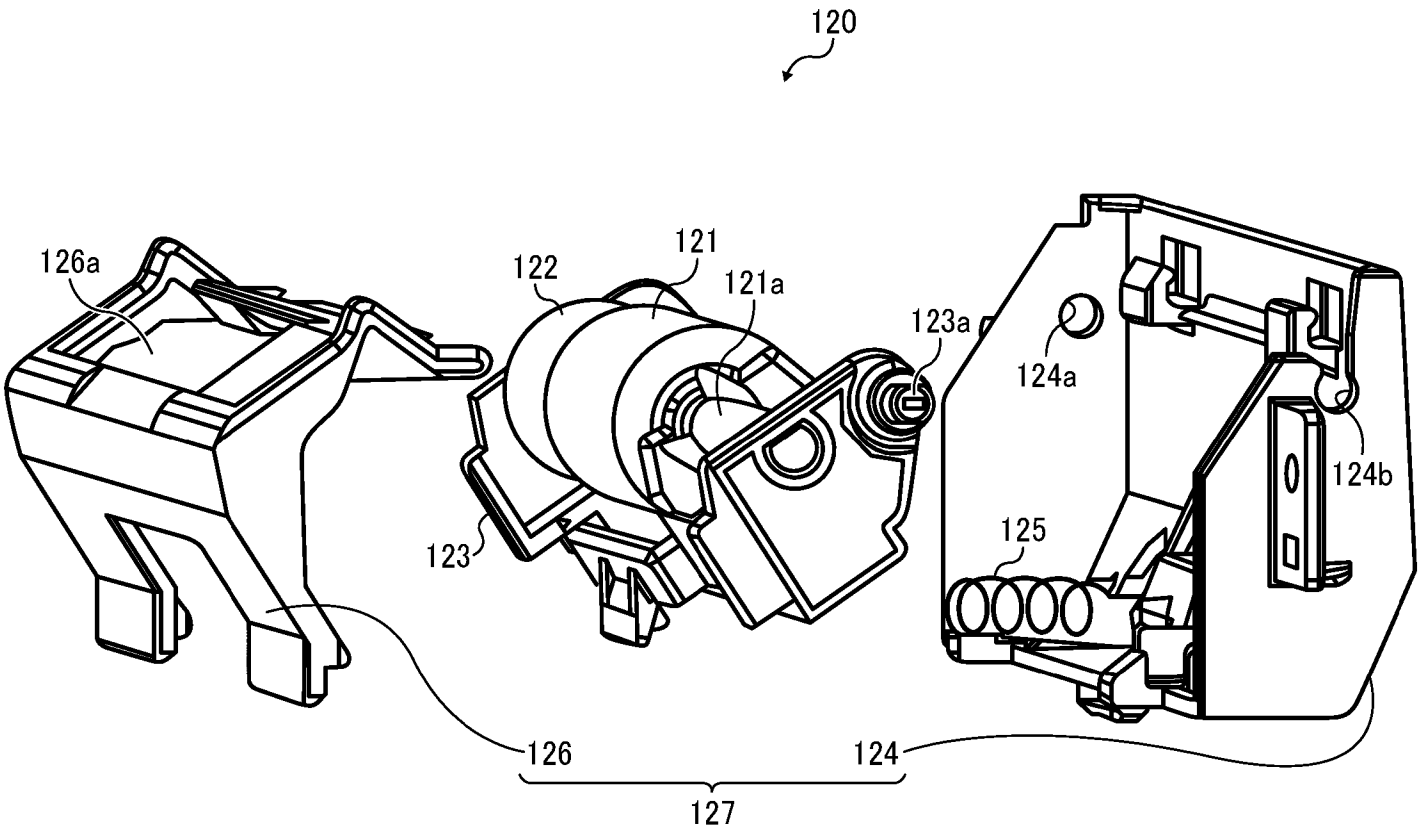
FIG. 14 is a partial perspective view illustrating the sheet tray viewed from a rear side thereof.

FIG. 14 is an exploded perspective view illustrating the separation roller unit 120.

As illustrated in FIG. 14, the separation roller unit 120 includes the sheet separating roller 121, the torque limiter 122, a swing holder 123, a coil spring 125, a cover unit 127 including a top cover 126 and a base cover 124, and the like.

The one end of the rotary shaft 121*a* of the sheet separating roller 121 is rotatably supported by and connected to the torque limiter 122. The functions of the torque limiter 122 is described above. The torque limiter 122 and the sheet separating roller 121 are held by the swing holder 123. The other side of the torque limiter 122, which is an opposite side thereof facing and being connected to the rotary shaft 121*a* of the sheet separating roller 121, is fixed to a right side plate of the swing holder 123. Further, the other end of the rotary shaft 121*a* of the sheet separating roller 121 is rotatably supported by a left side plate of the swing holder 123.

Accordingly, the swing holder 123 that holds the torque limiter 122 and the sheet separating roller 121 is contained in the cover unit 127 that functions as a containing device including the top cover 126 and the base cover 124. Specifically, respective swing shafts 123*a* are provided along a coaxial line on both the right side plate and the left side plate of the swing holder 123. The base cover 124 has a shaft hole 124*a* and a cutout 124*b*. One of the swing shafts 123*a* is engaged with the shaft hole 124*a* and the other of the swing shafts 123*a* is engaged with the cutout 124*b*. Accordingly, the swing holder 123 is supported by the base cover 124 so as to rotate about the swing shafts 123*a*.

The top cover 126 fits to the base cover 124 from above. In this state, a circumferential surface of the sheet separating roller 121 disposed inside the cover unit 127 is exposed through an opening 126*a* of the top cover 126 illustrated in FIG. 14. The base cover 124 further includes the coil spring 125 that functions as a spring or a biasing member. The coil spring 125 is fixed to the base cover 124, so that the coil spring 125 biases the swing holder 123 centering the swing shaft 123*a* from the base cover 124 toward the top cover 126. When the separation roller unit 120 is not attached to the sheet tray 100 as illustrated in FIG. 13, the circumferential surface of the sheet separating roller 121 contacts a rear side of the top cover 126.

In the image forming apparatus 1000 according to this example, a right end face of the apparatus body 50 in FIG. 1 is a front side of the image forming apparatus 1000 and a left end face of the apparatus body 50 is the rear side of the image forming apparatus 1000. A far side or an inward side in a direction perpendicular to a sheet face of FIG. 1 is a right side of the apparatus body 50 and a near side or an outward side in the direction perpendicular to the sheet face of FIG. 1 is a left side thereof. Specifically, when detaching the sheet tray 100 that is placed inside the apparatus body 50 of the image forming apparatus 1000, a user pulls out the sheet tray 100 to the front side of the apparatus body 50. By contrast, when attaching the sheet tray 100, the user inserts the sheet tray 100 into the apparatus body 50 toward the rear side of the image forming apparatus 1000. Hereinafter, a direction from the rear side to the front side of the image forming apparatus 1000 along a tray attaching/detaching direction is referred to as a "front side direction" and an opposite direction to the front side direction is referred to as a "rear side direction".

Figure 15:
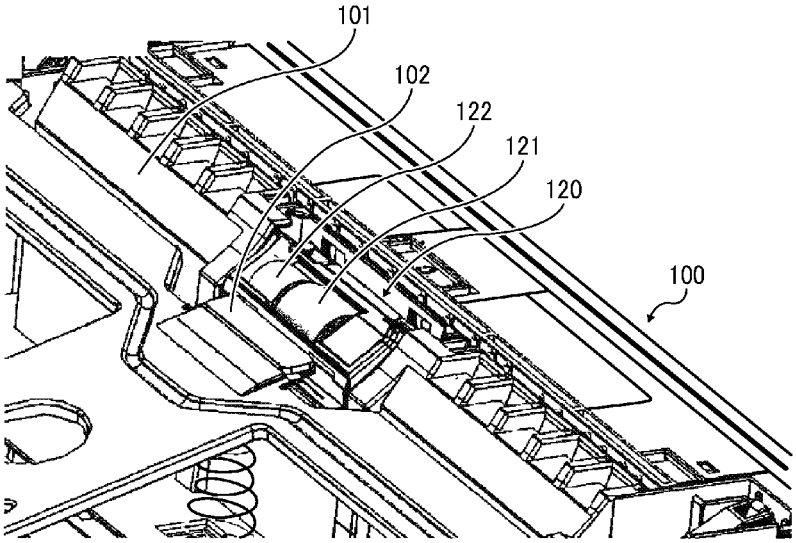
FIG. 15 is a partial perspective view illustrating the sheet tray viewed from a front side thereof.

As illustrated in FIG. 15, when the separation roller unit 120 is attached to an attaching part of the sheet tray 100, the bottom plate pad 102 that is fixed to a leading end of the movable bottom plate 101 of the sheet tray 100 comes in the vicinity of the rear side of the sheet separating roller 121. As described above, the bottom plate pad 102 presses the sheet S accommodated in the sheet tray 100 toward the sheet feed roller 35.

FIG. 16 is a partial perspective view illustrating the separation roller unit 120 included in the sheet tray 100 attached to the apparatus body 50 and the sheet feed roller 35 that is fixed to the apparatus body 50.

During the process for attaching the sheet tray 100 in the apparatus body 50, the sheet feed roller 35 that is fixed to the inside of the apparatus body abuts against the sheet separating roller 121 held by the sheet tray 100. More specifically, before contacting the sheet feed roller 35, part of the circumferential surface of the sheet separating roller 121 projects outwardly from the top cover 126 through the opening 126*a* as illustrated in FIG. 14 on the top cover 126 in the separation roller unit 120. In this state, the sheet separating roller 121 is gradually pushed into the apparatus body 50 together with the sheet tray 100, and eventually abuts against the circumferential surface of the sheet feed roller 35 fixed to the inside of the apparatus body 50.

As the sheet tray 100 is further pushed into the apparatus body 50, the sheet feed roller 35 is pushed back by the sheet separating roller 121. Due to this pushing back force, the swing holder 123 starts revolving about the swing shafts 123*a* from the top cover 126 toward the base cover 124 against the biasing force of the coil spring 125. Thus, the sheet separating roller 121 is gradually revolved about the swing shafts 123*a* in a direction from the sheet feed roller 35 to the sheet separating roller 121. Along with the movement of the sheet separating roller 121, the contact portions of the sheet feed roller 35 and the sheet separating roller 121 move in the direction from the sheet feed roller 35 to the sheet separating roller 121.

When the sheet tray 100 reaches the regular set position thereof, the sheet separating roller 121 is completely separated apart from the rear side of the top cover 126.

The sheet feed roller 35 includes a rotary shaft 35*a* having rotary shaft ends 35*a*1 and 35*a*2, and a roller part 35*b* having a roller shape.

The respective rotary shaft ends 35*a*1 and 35*a*2 are disposed both ends of the rotary shaft 35*a* and protrude from the opposite ends of the roller part 35*b* in an axial direction of the roller part 35*b*. Further, respective centers of the rotary shaft ends 35*a*1 and 35*a*2 of the rotary shaft 35*a* are hollow-shaped so that shafts such as a driving rotary shaft can be inserted thereto.

Figure 17:
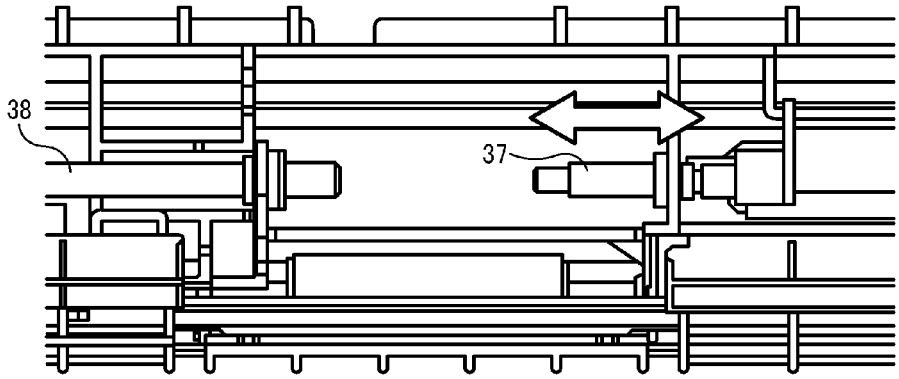
FIG. 17 is an enlarged view illustrating a sheet feed roller setting mechanism provided in the apparatus body.

FIG. 17 is an enlarged view illustrating a sheet feed roller setting mechanism provided in the apparatus body 50 as illustrated in FIG. 1.

The sheet feed roller setting mechanism for setting the sheet feed roller 35 includes a driving rotary shaft 38, an extendable shaft 37, and the like.

The driving rotary shaft 38 receives a driving force from a driving motor to rotate the sheet feed roller 35. The driving rotary shaft 38 has a circular cylindrical shape except for a leading end thereof. The leading end of the driving rotary shaft 38 has a D-like shape in cross section. Hereinafter, the D-like shape is referred to as a "D shape". As illustrated in FIG. 16, the sheet feed roller 35 has the rotary shaft 35*a* having the rotary shaft ends 35*a*1 and 35*a*2. The extendable shaft 37 illustrated in FIG. 17 is inserted into the rotary shaft end 35*a*2 that protrudes from the right side of the roller part 35*b* in FIG. 16. The driving rotary shaft 38 illustrated in FIG. 17 is inserted into the rotary shaft end 35*a*1 that protrudes from the left side of the roller part 35*b* in FIG. 16. The extendable shaft 37 functions as a support as well as the load resistance applying mechanism.

The rotary shaft end 35*a*1 functions as a first rotary shaft end and the rotary shaft end 35*a*2 functions as a second rotary shaft end.

The hollow in the rotary shaft end 35*a*1 in FIG. 16 has a D shape in cross section. Therefore, the driving rotary shaft 38 fits to the rotary shaft end 35*a*1. Further, with the rotary shaft end 35*a*1 and the driving rotary shaft 38 fitting to each other, the sheet feed roller 35 rotates together with the driving rotary shaft 38.

Figure 18:
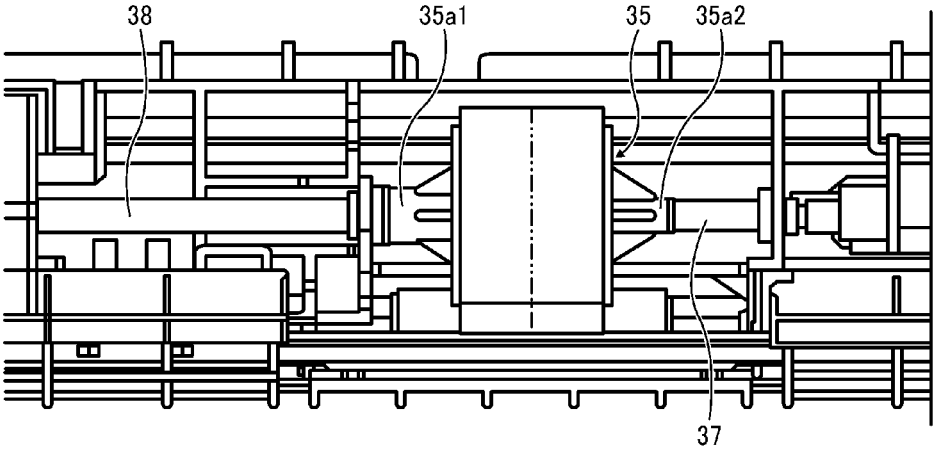
FIG. 18 is an enlarged view illustrating the sheet feed roller setting mechanism with the sheet feed roller set thereto.

The extendable shaft 37 is fixedly unrotated and is extended and contracted in directions indicated by arrow in FIG. 17. Usually, the extendable shaft 37 is fully extended due to a biasing force applied by a spring 37*c* (refer to FIGS. 19 and 20) that is coaxially disposed around the extendable shaft 37. Pressing the leading end toward a trailing end thereof contracts the extendable shaft 37. By so doing, space is created between the leading end of the driving rotary shaft 38 and the leading end of the extendable shaft 37 to insert the sheet feed roller 35 thereto. With the extendable shaft 37 being contracted, the sheet feed roller 35 is moved toward the driving rotary shaft 38 in the axial direction of the sheet feed roller 35, so that the D-shaped leading end of the driving rotary shaft 38 is inserted into the D-shaped rotary shaft end 35*a*1 of the rotary shaft 35*a* of the sheet feed roller 35. Thereafter, by stretching the extendable shaft 37 as illustrated in FIG. 17, the leading end of the extendable shaft 37 is inserted into the rotary shaft end 35*a*2 of the rotary shaft 35*a* of the sheet feed roller 35. Thus, as illustrated in FIG. 18, the setting of the sheet feed roller 35 is completed.

Figure 19:
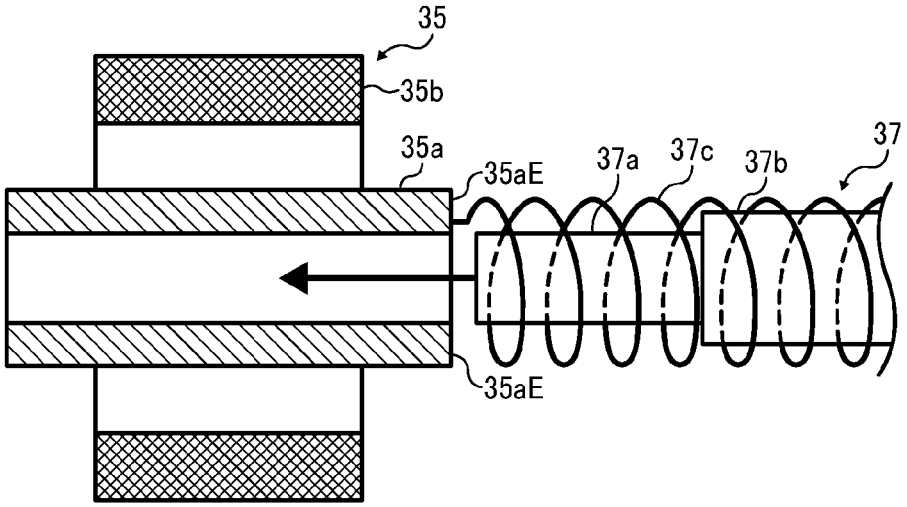
FIG. 19 is an enlarged view illustrating the sheet feed roller and an extendable shaft in a state in which the extendable shaft is about to be inserted into the sheet feed roller.
Figure 20:
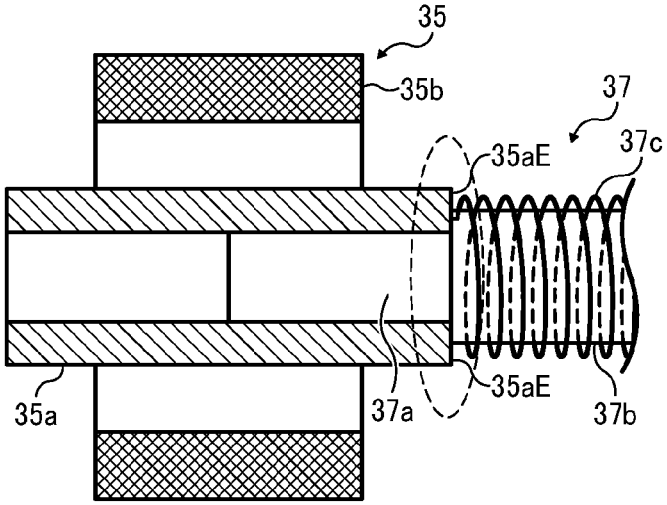
FIG. 20 is an enlarged view illustrating the sheet feed roller and the extendable shaft inserted to the sheet feed roller.

As described above, the extendable shaft 37 illustrated in FIG. 17 is inserted into the rotary shaft end 35*a*2 of the rotary shaft 35*a* of the sheet feed roller 35. The hollow in the rotary shaft end 35*a*2 has a perfect circular shape in cross section as illustrated in FIG. 16. Further, the leading end of the extendable shaft 37 illustrated in FIG. 17 also has a perfect circular shape in cross section. More specifically, as illustrated in FIG. 19, the leading end of the extendable shaft 37 has a two-step circular cylindrical shape that has a small diameter portion 37*a* and a large diameter portion 37*b*. The small diameter portion 37*a* is disposed further than the large diameter portion 37*b* from a fixed end of the extendable shaft 37. The large diameter portion 37*b* functions as a pressing unit.

When the sheet feed roller 35 is set in the sheet feed roller setting mechanism, the extendable shaft 37 is not fully extended. More specifically, the extendable shaft 37 is not fully but substantially extended. The extendable shaft 37 is not fully extended since the large diameter portion 37*b* of the extendable shaft 37 is pressed against an end face 35*a*E of the rotary shaft end 35*a*2 that functions as a second rotary shaft end, as illustrated with a dotted line in FIG. 20. When the large diameter portion 37*b* of the extendable shaft 37 is closely pressed against the end face 35*a*E of the rotary shaft end 35*a*2, a rotational load resistance is applied to the sheet feed roller 35. Specifically, the extendable shaft 37 functions as a load resistance applying mechanism to apply the rotational load resistance that is different from a contact force generated by contacting the sheet separating roller 121, to the sheet feed roller 35 with no rotation driving force applied thereto.

Further, the load resistance that is applied by the large diameter portion 37*b* of the extendable shaft 37 acts on the sheet feed roller 35 in the rotation axis direction. However, the load resistance applied between the large diameter portion 37*b* and the end face 35*a*E of the rotary shaft end 35*a*2 of the rotary shaft 35*a* of the sheet feed roller 35 acts as a rotational load resistance.

The rotary shaft ends 35*a*1 and 35*a*2 of the rotary shaft 35*a* of the sheet feed roller 35 are made of a polyacetal resin having a relatively smaller frictional resistance, and the like. When the sheet feed roller 35 rotates, the rotary shaft ends 35*a*1 and 35*a*2 of the sheet feed roller 35 rotate while slipping on the circumferential surface of the extendable shaft 37 that remain unrotated. Even at this time, the extendable shaft 37 applies a certain degree of the rotational load resistance on the sheet feed roller 35. However, this rotational load resistance is much smaller than the torque for driving the sheet feed roller 35, and therefore not likely to cause any inconvenience.

Figure 21:
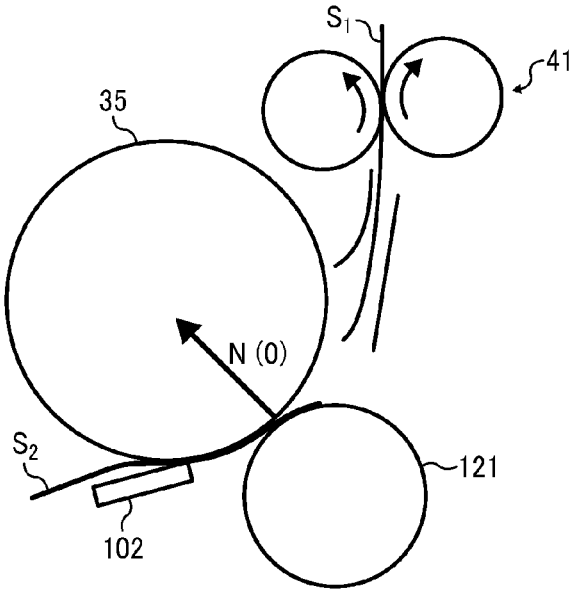
FIG. 21 is a diagram illustrating a state in which a trailing end of a preceding sheet of two sheets held in a sheet separation nip region is passed from the sheet separation nip region and a subsequent sheet of the two sheets abuts against the sheet feed roller.

FIG. 21 is a diagram illustrating a state in which a trailing end of a preceding sheet S1 of two sheets held in the sheet separation nip region due to multi feed is passed from the sheet separation nip region and a subsequent sheet S2 of the two sheets abuts against the sheet feed roller 35. At a timing earlier than this state, the sheet feed roller 35 is stopped from rotating, and therefore the preceding sheet S1 is conveyed by the rotation driving force of the first conveying roller pair 41. Therefore, in the state illustrated in FIG. 21, rotation of the sheet feed roller 35 is completely stopped.

At this time, the sheet separating roller 121 is displaced by an amount corresponding to the thickness of the preceding sheet S1. By so doing, the slight reverse rotation of the sheet feed roller 35 is prevented by applying a force of the sheet separating roller 121 that passes the subsequent sheet S2 against the surface of the sheet feed roller 35. To do so, a load resistance force F as described below is applied.

The load resistance force F that causes the slight reverse rotation of the sheet feed roller 35 has a value obtained by multiplying a pressure value N(0) between the sheet feed roller 35 and the sheet separating roller 121 by the friction coefficient μ between the sheet feed roller 35 and the subsequent sheet S2. Accordingly, the relation of the load resistance force F and the pressure value N(0) is expressed as "$F>\mu N(0)$". The load resistance force F is applied to the rotary shaft 35*a* of the sheet feed roller 35 by the large diameter portion 37*b* of the extendable shaft 37.

Figure 22:
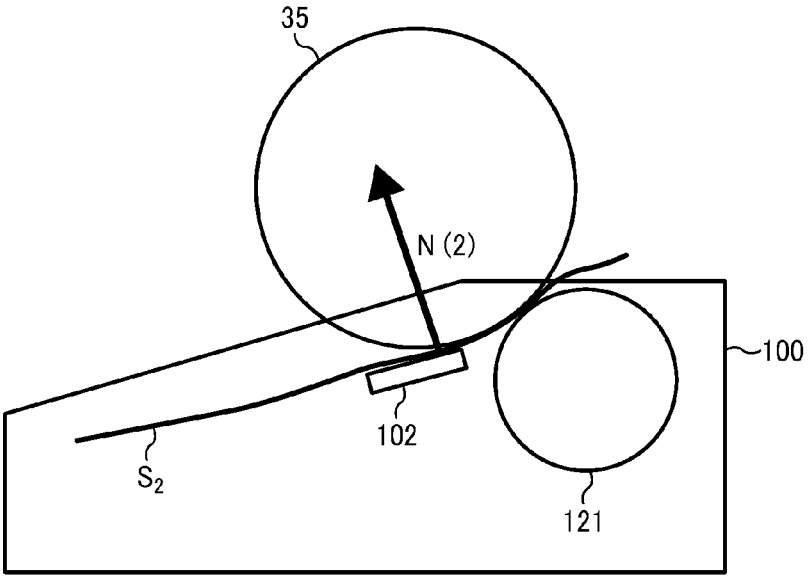
FIG. 22 is a diagram illustrating a state in which the sheet tray with a leading end of the subsequent sheet being placed on the sheet separating roller is set to the apparatus body.

FIG. 22 is a diagram illustrating a state in which the sheet tray 100 with the leading end of the subsequent sheet S2 being placed on the sheet separating roller 121 is set to the apparatus body 50.

As described above, generation of crease in the subsequent sheet S2 can be prevented by moving the sheet feed roller 35 in a reverse direction that is opposite to the regular sheet feeding direction as the sheet separating roller 121 in contact with the sheet feed roller 35 via the subsequent sheet S2 interposed therebetween moves from the right side to the left side in FIG. 22 when the sheet tray 100 is inserted into the apparatus body 50.

In FIG. 21, the force that induces the slight reverse rotation of the sheet feed roller 35 is generated by the biasing force of the coil spring 125 that biases the sheet separating roller 121 toward the sheet feed roller 35. Therefore, this force is significantly small.

By contrast, in FIG. 22, the force that induces the reverse rotation of the sheet feed roller 35 is generated when the sheet separating roller 121 is inserted into the apparatus body 50 together with the sheet tray 100. The force is generated by the user pushing the sheet tray 100 to the apparatus body 50. Therefore, this force is significantly large.

Accordingly, by making the load resistance force F smaller than the above-described force and greater than the value $\mu N(0)$, the slight reverse rotation is prevented in the state illustrated in FIG. 21 and the rotation of the sheet feed roller 35 with the sheet separating roller 121 is allowed in the state illustrated in FIG. 22.

In FIG. 22, the force that causes the sheet feed roller 35 to be rotated in the opposite direction to the sheet feeding direction has the value obtained by multiplying the pressure value (the sheet feeding pressure value) generated between the sheet feed roller 35 and the bottom plate pad 102 by the friction coefficient $\mu$ between the sheet feed roller 35 and the subsequent sheet S2. Accordingly, the relation of the load resistance force F and a pressure value N(2) is expressed as "$F<\mu N(2)$". As a result, by satisfying the relation of "$\mu \times N(0)<F<\mu \times N(2)$", generation of crease due to the slight reverse rotation of the sheet feed roller 35 and generation of crease due to attachment and detachment of the sheet tray 100 with respect to the apparatus body 50 can be prevented.

It is to be noted that the relation of "$\mu \times N(0) \times Rf<Ts<\mu \times N(2) \times Rf$" is satisfied, where "Rf" represents a radius of the sheet feed roller 35 and "Ts" represents a load torque of the large diameter portion 37*b* of the extendable shaft 37. If a separation pressure is 1.5 [N], a sheet feed pressure is 3 [N], and the friction coefficient "$\mu$" is 0.6, the load resistance force F falls within a range of from 0.9 [N] to 1.8 [N].

Figure 23:
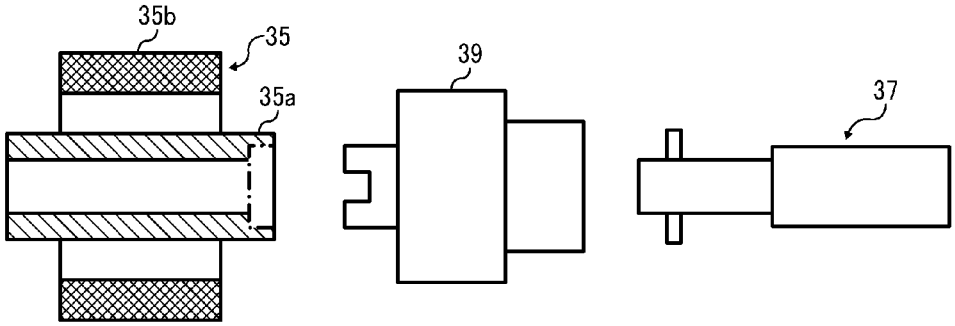
FIG. 23 is a diagram illustrating a sheet feed roller setting mechanism according to another example of this disclosure.
Figure 24:
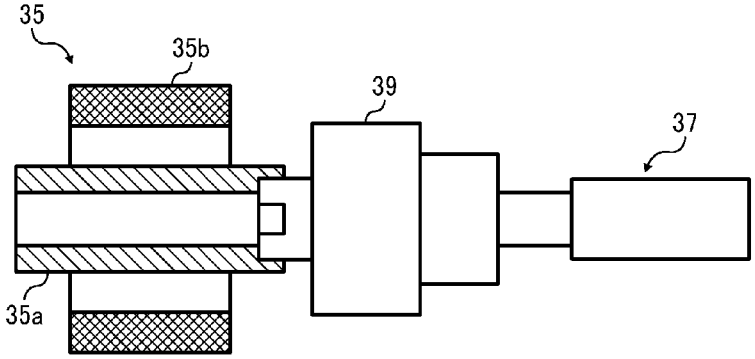
FIG. 24 is a diagram illustrating the sheet feed roller setting mechanism of FIG. 23, with the sheet feed roller is set thereto.

Next, a description is given of a sheet feed roller setting mechanism of the image forming apparatus 1000 according to another example of this disclosure, with reference to FIGS. 23 and 24.

FIG. 23 is a diagram illustrating the sheet feed roller setting mechanism of the image forming apparatus 1000 according to another example of this disclosure. FIG. 24 is a diagram illustrating the sheet feed roller setting mechanism of FIG. 23, with the sheet feed roller 35 is set thereto. In this example, the sheet feed roller setting mechanism includes a load torque limiter 39 that functions as a load resistance applying mechanism instead of the extendable shaft 37 that remains unrotated in this example.

As illustrated in FIG. 24, one end of the load torque limiter 39 in the rotation axis direction thereof is inserted into the rotary shaft end 35*a*2 that functions as a second rotary shaft end of the sheet feed roller 35. Further, the unrotated extendable shaft 37 is inserted into the other end of the load torque limiter 39 in the rotation axis direction thereof.

If the torque exerted on the load torque limiter 39 exceeds a given threshold value thereof, the load torque limiter 39 rotatably holds the rotary shaft 35*a* of the sheet feed roller 35, so that the sheet feed roller 35 can rotate.

By contrast, if the torque exerted on the load torque limiter 39 is equal to or smaller than the given threshold value, the load torque limiter 39 holds the rotary shaft 35*a* unrotated, so that the sheet feed roller 35 cannot rotate.

Specifically, the load torque limiter 39 limits rotation of the sheet feed roller 35 and allows the rotation thereof when the torque exceeding the given threshold value of the sheet feed roller 35 is applied to the rotary shaft 35*a* of the sheet feed roller 35. The given threshold value is set to be greater than the value $\mu N(0)$.

Further, the extendable shaft 37 does not apply the load resistance force F in this example.

Figure 25:
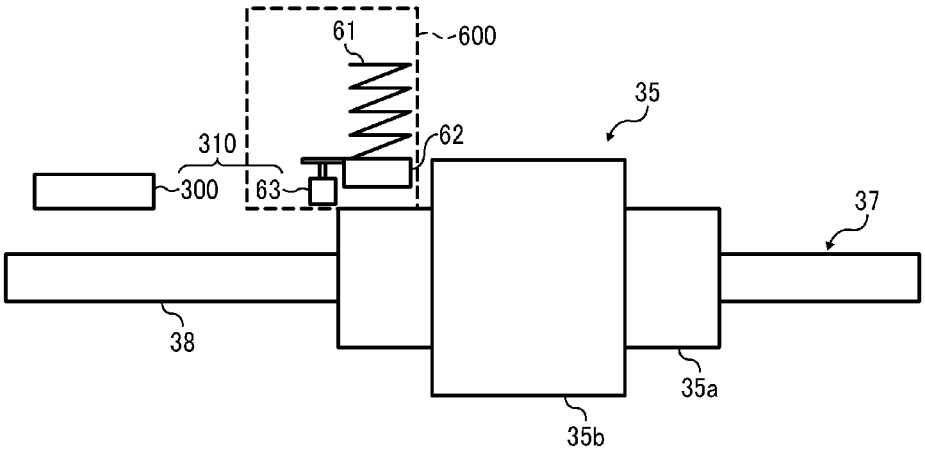
FIG. 25 is a diagram illustrating a sheet feed roller setting mechanism according to yet another example of this disclosure.
Figure 26:
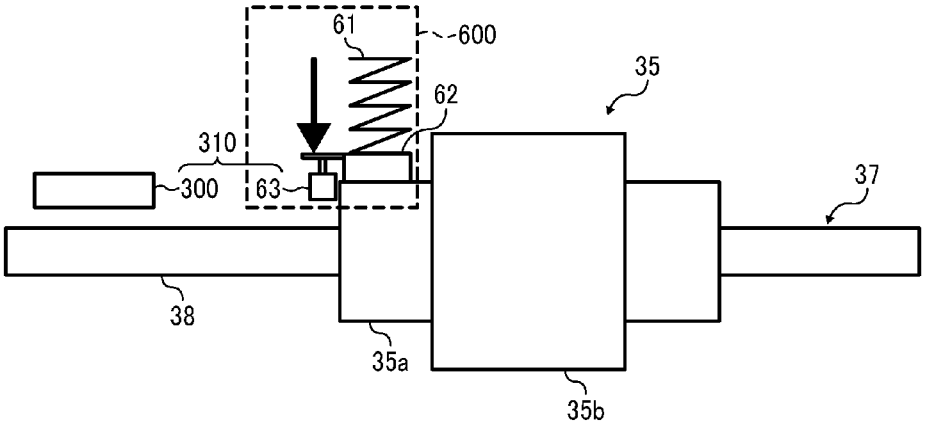
FIG. 26 is a diagram illustrating the sheet feed roller setting mechanism of FIG. 25, with the sheet feed roller is stopped by a brake.

Next, a description is given of a sheet feed roller setting mechanism of the image forming apparatus 1000 according to yet another example of this disclosure, with reference to FIGS. 25 and 26.

FIG. 25 is a diagram illustrating the sheet feed roller setting mechanism of the image forming apparatus 1000 according to yet another example of this disclosure. FIG. 26 is a diagram illustrating the sheet feed roller setting mechanism of FIG. 25, with the sheet feed roller 35 is stopped by a brake. In this example, the sheet feed roller setting mechanism includes a braking mechanism 600 that functions as a load resistance applying mechanism instead of the extendable shaft 37.

The braking mechanism 600 includes a braking spring 61, a braking pad 62, and a release solenoid 63. The braking spring 61 applies a biasing force to bias the braking pad 62 toward the circumferential surface of the rotary shaft 35*a* of the sheet feed roller 35. The braking pad 62 is disposed facing the circumferential surface of the rotary shaft 35*a* of the sheet feed roller 35. The release solenoid 63 presses back the braking pad 62 against the biasing force applied by the braking spring 61.

The release solenoid 63 has a shaft thereof. When the release solenoid 63 is magnetized, the shaft of the release solenoid 63 is contracted as illustrated in FIG. 26. Contraction of the shaft of the release solenoid 63 causes the braking pad 62 to be pressed against the circumferential surface of the rotary shaft 35*a* of the sheet feed roller 35. This action applies a brake to the sheet feed roller 35.

By contrast, when the release solenoid 63 is not magnetized, the shaft of the release solenoid 63 is stretched as illustrated in FIG. 25. Extension of the shaft of the release solenoid 63 causes the braking pad 62 to separate from the circumferential surface of the rotary shaft 35*a* of the sheet feed roller 35. Due to this action, the sheet feed roller 35 is released from braking.

This braking prevents slight reverse rotations of the sheet feed roller 35 that occurs during printing jobs. Such slight reverse rotations are caused within a time period during which the sheet feed roller 35 is not rotated during the printing jobs. Therefore, the controller 300 magnetizes the release solenoid 63, so as to apply a brake during the time period. During the other time periods, magnetization of the release solenoid 63 is stopped and the brake is released. Thus, when the sheet feed roller 35 rotates, the braking is released. This can prevent wasted energy consumption and component wear due to braking during rotational driving thereof.

Further, according to this configuration, combination of the release solenoid 63 and the controller 300 functions as a load resistance releasing mechanism 310.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeding apparatus comprising:

an apparatus body;

a sheet container detachably attachable to the apparatus body, the sheet container configured to accommodate recording media therein;

a sheet feeding rotary body configured to rotate about a rotary shaft thereof, and to feed the recording media from the sheet container;

a sheet separating rotary body connected to the sheet container and detachably attachable to the apparatus body together with the sheet container; and a load resistance applying mechanism including a pressing device configured to press against the rotary shaft of the sheet feeding rotary body to apply a rotational load to the sheet feeding rotary body.

2. The sheet feeding apparatus according to claim 1, wherein the sheet container is configured to pull out from the sheet feeding apparatus through an end of the apparatus body at which the sheet separating rotary body is located during operation such that a sheet separation nip region between the sheet separating rotary body and the sheet feeding rotary body is released when the sheet container is pulled out from the sheet feeding apparatus.

3. The sheet feeding apparatus according to claim 1, wherein the sheet separating rotary body is configured to contact the sheet feeding rotary body and to rotate about a rotary shaft of the sheet feeding rotary body with a sheet separation nip region formed between the sheet separating rotary body and the sheet feeding rotary body.

4. The sheet feeding apparatus according to claim 1, wherein the load resistance applying mechanism is configured to apply the rotational load to the sheet feeding rotary body to resist rotation in response to a contact force generated when the sheet container is inserted in the apparatus body such that the sheet separating rotary body comes into contact with the sheet feeding rotary body while a driving motor does not apply a rotation driving force to the sheet feeding rotary body.

5. The sheet feeding apparatus according to claim 1, further comprising:

a rotation adjusting unit configured to perform an adjustment such that a recording medium that directly contacts the sheet feeding rotary body is separated from the multiple recording media and is fed toward the image forming part when the multiple recording media are fed from the sheet container and held in a sheet separation nip region formed between the sheet separating rotary body and the sheet feeding rotary body, wherein the sheet feeding rotary body is configured to press against the recording media in the sheet container attached to the apparatus body, and to feed the recording media one by one from the sheet container to a sheet separation nip region formed between the sheet separating rotary body and the sheet feeding rotary body.

6. The sheet feeding apparatus according to claim 1, further comprising:

a load resistance releasing mechanism to release the rotational load applied by the load resistance applying mechanism.

7. The sheet feeding apparatus according to claim 5, wherein the rotary shaft of the sheet feeding rotary body includes an end face, and the pressing device is configured to press against the end face of the rotary shaft.

8. The sheet feeding apparatus according to claim 7, further comprising:

a first rotary shaft end located at one end of the rotary shaft of the sheet feeding rotary body in a rotation axis direction of the sheet feeding rotary body;

a second rotary shaft end located at an opposite end of the rotary shaft of the sheet feeding rotary body in the rotation axis direction; and a driving rotary shaft to apply a rotation driving force to the sheet feeding rotary body by coaxially rotating with the rotary shaft of the sheet feeding rotary body while fitting to the first rotary shaft end, wherein the load resistance applying mechanism includes, a biasing member configured to generate a biasing force, and a support configured to slidably move in the rotation axis direction of the sheet feeding rotary body, and to rotatably support the second rotary shaft end by fitting to the second rotary shaft end, the pressing device configured to press the support against the end face of the second rotary shaft end of the sheet feeding rotary body based on the biasing force.

9. The sheet feeding apparatus according to claim 7, further comprising:

a load resistance releasing mechanism to release the rotational load applied by the load resistance applying mechanism.

10. The sheet feeding apparatus according to claim 9, wherein the load resistance applying mechanism is a torque limiter to allow rotation of the sheet feeding rotary body when a torque exceeding a threshold value is applied to the rotary shaft of the sheet feeding rotary body.

11. An image forming apparatus comprising:

an apparatus body;

the sheet feeding apparatus according to claim 1; and an image forming device configured to form an image on the recording media fed by the sheet feeding apparatus.

* * * * *